United States Patent [19]

Sivachenko et al.

[11] 4,120,065

[45] Oct. 17, 1978

[54] LIGHTWEIGHT MODULAR, TRUSS-DECK BRIDGE SYSTEM

[75] Inventors: Eugene W. Sivachenko, 6471 Riverside Dr., Redding, Calif. 96001; Firoze H. Broacha, Lakewood, Colo.; Artemas M. Larkin, Redding, Calif.

[73] Assignee: Eugene W. Sivachenko, Redding, Calif.

[21] Appl. No.: 860,796

[22] Filed: Dec. 15, 1977

[51] Int. Cl.[2] ..... E01D 15/00

[52] U.S. Cl. ..... 14/6; 14/17; 14/73; 52/796; 52/797

[58] Field of Search ..... 14/17, 3, 4, 6, 13, 14/73, 1; 52/618, 625, 630

[56] References Cited

U.S. PATENT DOCUMENTS

| | | | |
|---|---|---|---|
| 2,017,832 | 10/1935 | Hovey | 14/73 X |
| 3,037,592 | 6/1962 | Shipley | 52/618 X |
| 3,066,771 | 12/1962 | Wolchuk | 52/618 X |
| 3,104,194 | 9/1963 | Zahorski | 52/618 X |
| 3,110,049 | 11/1963 | Nagin | 14/73 |
| 3,302,361 | 2/1967 | Oudheusden | 14/73 X |
| 3,388,516 | 6/1968 | Thitzen | 52/618 X |
| 3,849,237 | 11/1974 | Zetlin | 52/618 X |

*Primary Examiner*—Nile C. Byers
*Attorney, Agent, or Firm*—Townsend and Townsend

[57] ABSTRACT

A modular bridge system constructed of parallel, side-by-side bridge modules constructed of components made from large pitch and depth corrugated plate. Each module has an upper chord plate, which ultimately defines the corresponding part of the bridge deck, a spaced apart, parallel lower chord plate and an intermediate, sinusoidal support structure defined by webs which have a width substantially equal to the width of the chord plates so as to define a continuous lateral support for the upper chord plates at intermediate points over the length thereof. Load distributing ribs secured to the underside of the chord plates only are placed at unsupported portions of the upper chord plates between attachment points for the webs and have a width substantially equal to the combined width of all modules to tie the modules to each other and to distribute vehicular (point) loads over a relatively wide lateral extent of the chord plates. Also disclosed is a high strength mounting of lateral guard rails for the bridge, a method for constructing and erecting the modules, and the incorporation of the modules in more intricate bridge structures such as arch-type bridges.

71 Claims, 31 Drawing Figures

LIGHTWEIGHT MODULAR, TRUSS-DECK BRIDGE SYSTEM

BACKGROUND OF THE INVENTION

At the present there are in the U.S. alone upwards of 105,000 inadequate highway bridges. A majority of them are functionally obsolete while a lesser number of them are structurally deficient. The latter are defined as bridges which had to be restricted to light vehicles only or closed, while the former are identified as bridges which can no longer safely service the system of which they are an integral part. The problem is of such magnitude that the U.S. Congress intervened with a special Bridge Replacement Program pursuant to Section 204 of the Federal-Highway Act of 1970. In a recent report pursuant to that program the Federal Government estimated in May of 1977 that the replacement cost for the deficient bridges on a current dollar basis is approximately 23 billion dollars. The actual cost for replacing deficient or obsolete bridges is substantially higher, since not all such bridges were or could be inventoried. Informed estimates place the real replacement cost at around 30 billion dollars.

About two-thirds of these bridges are relatively small bridges having a span of 30 to 100 feet. Many, if not most of them are in remote locations, are accessible by narrow highways only, and are not within easy reach of the equipment, especially heavy cranes, needed for the erection of conventional bridges.

In view of the immensity of the U.S. bridge deficit attempts have been made to economize the construction of bridges. To the present, no bridge structure has been developed that can be reliably produced in large quantities, is readily, i.e. inexpensively transported to the construction site, and can there be erected, all in compliance with the bridge specifications of the American Association of Highway and Tranportation Officials (hereinafter AASHTO). Currently, efforts are being made to devise prestressed concrete bridge structures to fill the need. They have, however, several problems.

First, the great weight of concrete members requires special transportation and hoisting equipment. In many instances, the access to the construction site might be insufficient for such equipment, especially cranes with the necessary capacity of as much as 100 to 250 tons, unless the equipment is first dismantled. This greatly increases the overall costs for replacing an obsolete bridge.

Secondly, there is an apparent inability to organize and disperse manufacturing outlets in a sufficiently large number and over a sufficient geographic area so as to reduce the significant transportation costs for such heavy elements as concrete bridge structures.

Thirdly, present day technology makes it difficult if not impossible to adequately control the quality of prefabricated concrete so as to enable the construction of structurally efficient bridges, that is of bridges which are not excessively heavy so as to compensate for possible material defects.

In view of the foregoing problems surrounding National Bridge Replacement Program, the replacement of bridges presently proceeds at a very slow pace. Only a few thousand bridges within the Federal Bridge Replacement Program have been replaced over the last five years. At that rate it would require half a century or more to fully upgrade tha national bridge inventory. Of course, in addition to the replacement program new bridges for new roads and highways are required on an ongoing basis, thereby further increasing the demand for bridges.

A bridge structure which is not afflicted with the above summarized shortcomings of prior art structures is therefore urgently needed by this nation as well as on a worldwide basis.

The Relevent Prior Art

Technically, a bridge distinguishes from other, outwardly similar structures which form a free span between two upright supports or abutments, such as roofs, for example, in that a bridge is subjected to a concentrated, moving vehicular loads (hereinafter "vehicular load"). Such loads are concentrated on a relatively small area underlying the wheels of the vehicles. WHile similar structures, such as roofs, carry a load that is stationary and evenly distributed and which therefore is carried by the whole roof, the same load total applied to a bridge is carried by a small portion of the bridge as the vehicle moves thereover and causes stress concentrations, particularly in the bridge deck, which make it necessary to build the bridge substantially stronger than a roof. Bridges must therefore be constructed quite different from other, outwardly similar suspended structures.

Generally speaking, the construction of a bridge requires two essential components. First, the flat, upper deck which carries the vehicular traffic and, secondly, a load carrying support for the deck. Conventionally, this has been accomplished by suspending parallel, longitudinally extending girders between upright bridge supports or abutments and placing a deck such as wood or metal planking over the girders. The lateral spacing of the girders (in a direction perpendicular to the length of the bridge) must be chosen so that the vehicular load does not overstress the bridge deck between adjacent girders. Consequently, conventional bridges normally have a relatively large number of parallel girders.

Depending on the particular bridge and, to a more limited extent, on the designer's choice, bridge girders normally are either preformed or fabricated H beams or, for larger bridges, trusses fabricated from a variety of profiles such as channels, H beams, angles and plates riveted, bolted or welded to each other. Since such bridges are exposed to the weather and since corrosion protective coatings are of limited life, all members must be constructed of relatively heavy walled materials, normally having thicknesses well in excess of ¼ inch to prevent the danger of a weakening of the bridge in the event there is localized corrosion due to a breakdown of the coating. Such heavy walled material, however, is difficult to work and fabricate, in fact, the larger bridges principally rely on straight profiles that are cut to length and individually assembled.

Bridges of this type, though entirely satisfactorily in service, are relatively expensive because of their great weight. The great weight in part is due to an inherently inefficient design when constructing girders and trusses as above outlined. The weight is further increased by the deadweight of the deck itself which may approach or exceed the weight of the load carrying members of the bridge. Since the cost of the bridge frequently is in direct proportion to its weight such bridges are relatively expensive.

A variety of means has heretofore been proposed to reduce the deadweight and the overall cost of the bridge. For example, prestressed concrete beams, the upper portions of which may define a bridge deck, have been relatively frequently used in the past, particularly for bridges with shorter span lengths. Prestressed concrete beams, however, have the above discussed disadvantages of an inadequately controlled quality and, perhaps, even more importantly, of being so heavy as to be difficult to transport to remote construction sites. Once at the site, the heavy weight of prestressed concrete beams may require cranes or similar hoisting equipment which is most difficult to transport to the site, to erect and to operate. All this substantially increases the cost of such bridges and correspondingly decreases their effectiveness as a bridge system for replacing the earlier discussed relatively short span bridges, particularly those at remote locations.

Although there are a variety of other bridge constructions, none is believed to be relevant to the present invention. Furthermore, the variety of shortcomings discussed above indicates the present need for an improved design which more efficiently utilizes the materials of which a bridge is constructed so as to enable an overall weight reduction and a resulting cost reduction for bridges.

SUMMARY OF THE INVENTION

Broadly speaking, the present invention provides a new bridge system which departs from past bridge building practices in a number of important aspects all of which combine to render the bridge system of the present invention substantially more economical. More specifically, the present invention addresses itself directly to the problem encountered in the above discussed National Bridge Replacement Program by reducing the cost and weight of the overall bridge. This is achieved through superior bridge design which utilizes all, not just some of the materials of which the bridge is constructed as is the case with prior art bridges and through an ability to utilize higher strength materials. Further the bridge of the present invention is prefabricated in multiple, substantially identical bridge modules at convenient permanent or temporary assembly plants so that the economies of mass production can be advantageously employed and the pre-assembled modules are a sufficiently small size and low weight so that they can be inexpensively transported to the bridge site with low cost transport equipment such as flat bed trucks. Equally important, bridge erection costs are minimized because the relatively small modules are easily hoisted into place and installed with small, inexpensive cranes, and a minimal amount of labor.

It presently appears that the bridge system of the present invention enables the replacement of obsolete bridges, as well as the installation of new bridges, at a cost which is as much as 30–50% less than the replacement or new cost of such bridges with presently available structures. An additional advantage flowing from the present invention is the fact that the bridge system of the present invention requires substantially less maintenance, thereby reducing the subsequent maintenance costs and/or enhancing the service life of the bridge. Accordingly, the present invention is an ideal vehicle for the implementation of the National Bridge Replacement Program.

In general terms, the above summarized advantages of the present invention are achieved because each bridge module simultaneously defines a bridge truss and the traffic carrying deck by using an upper chord plate of the truss as the bridge deck. The diagonals of the truss which interconnect the upper and lower chord plates have a weblike configuration, so that they extend over substantially the full width of the chord plates. In this manner, the webs rigidify the modules in a lateral direction and provide a uniform lateral support for the upper chord plate/bridge deck over its full width.

The bridge module makes extensive use of corrugated plate having relatively deep corrugations and a large corrugation pitch to increase the strength of the plate and to enable the use of high strength e.g. 50,000 psi yield strength steel. The steel is preferably corrosion resistant steel to eliminate the need for corrosion protective coatings and their subsequent maintenance. Further economies are achieved through the provision of intermittent load distributing ribs applied to the underside of the upper chord plates which distribute vehicular loads in a lateral bridge direction. Consequently, such loads are carried by a greater portion of the upper chord plates of the modules. As a result, the bridge of the present invention is more efficiently stressed and can be lighter than was heretofore possible.

Structurally, the modular bridge of the present invention comprises a plurality of side-by-side truss-deck modules, each having an upper chord plate that is constructed of the above-referenced corrugated plate and which simultaneously defines the upper chord plate of the truss and the deck of the finished bridge. A lower chord plate, preferably also constructed of corrugated plate, is secured to the upper chord plate with a plurality of serially arranged, sinusoidal web-like diagonals which are disposed between the chord plates. The webs or diagonals are inclined, e.g. slanted relative to the chord plates. Each includes a center section disposed between the chord plates, and is constructed of corrugated plate having a plurality of side-by-side corrugations which extend in the direction of the chord plate corrugations.

The modules are secured to each other to prevent relative lateral movement between them by overlapping lateral sides of the chord plates, preferably portions of the corrugations intermediate the corrugation peaks and valleys, and securing such portions to each other as with bolts, rivets, welds and the like. These are best placed at or in the vicinity of the neutral axis of the corrugations. Additionally, suitably placed tie straps may be provided to secure at least the lower chord plates to each other.

The upper chord plates are additionally secured to each other with load distribution ribs that span the combined width of the modules and which are oriented perpendicular to the bridge length. A load distribution rib is placed about midway between each pair of adjoining attachment points between the upper chord plate and the webs. The ribs are normally secured to the underside of the upper chord plates only, that is they are not secured to any other structure of the bridge and they are selected so that they have a section modulus whereby the vehicular (point) load is distributed over the maximum permissible lateral extent of the bridge as provided for in the AASHTO design standards. The presently permissible lateral load distribution as set forth in the AASHTO design standards is limited to a maximum of 7 feet and is further a function of the spacing between the upper chord plate-web attachment points (hereinafter "web spacing"). Accordingly, the load distribution ribs are selected so that they have a section modulus which effects the desired lateral distribution of the load over the upper chord plates without supporting the vehicular load on any other structural member of the brdige or transferring such load to bridge abutments, etc.

Aside from distributing the vehicular load laterally and strengthening the corrugated upper chord plate in a lateral direction perpendicular to the direction of the corrugations and thus more efficiently utilizing the chord plate, the load distribution rib further functions as a lateral tie member for the bridge modules in general and the upper chord plates in particular since each such rib is rigidly secured, e.g. bolted, riveted or welded to all upper chord plates of the bridge.

In a preferred embodiment of the invention, each diagonal web element is generally Z-shaped and is defined by an angularly inclined center section from which integrally constructed crown or end sections protrude. The crown sections are angularly inclined relative to the web center section and they are either parallel with respect to each other and substantially straight or, as is presently preferred, they are continuously curved. The crown sections engage and support the surfaces of the top and bottom chord plates which face each other. Although the crown sections can be flat, or they can be constructed of corrugated material which has a lesser corrugation depth and/or the corrugations of which have been flattened out, in a preferred embodiment of the invention the corrugations of the web center section and of its adjoining crown sections are continuous. In such instances, the transition between the end sections and the center section of the web is continuously curved so as to maintain the full strength of the corrugated web throughout its length.

It is preferred that all corrugated members, that is the upper chord plate, the lower chord plate when it is constructed of corrugated material, and the diagonal web elements be constructed of like corrugated plate to facilitate their manufacture, reduce their costs and render them compatible. To assure the nesting of the corrugated crown sections and the chord plates, the corrugated plates of which they are made may be constructed so that the corrugation peaks and troughs have base widths which alternatingly differ by about one material thickness so that the peak of one of them can fully nest in and contact the trough of the other one. The differential width of the peaks and valleys may be uniform, that is may be present throughout the length of the corrugations or it may be localized at the points where actual nesting occur. The latter is accomplished by placing the corrugated sheets (with uniform base widths) in suitable re-forming equipment such as press or rotary dies. Alternatively, when the corrugation peaks and troughs have like base widths, either the chord plates or the crown sections, and preferably the latter, include raised, generally cylindrical bosses which are dimensioned so that they contact the chord plates when the sides of the corrugation between the corrugation peaks and valleys abut each other. Fastening members, such as high strength bolts, rivets or welds firmly secure the raised bosses to the chord plates and, in the case of the former two, establish a firm friction connection between the chord plates and the crown sections.

A bridge constructed as above outlined utilizes all bridge components, namely the upper chord plate, which simultaneously defines the bridge deck, as well as the other components of the module in a load carrying capacity. Thus, the deck, instead of comprising deadweight, becomes a load carrying member or, alternatively, it can be considered as simply deleted as a separate component of the bridge as it is commonly known. The overall weight of a bridge is thereby significantly reduced.

Another aspect of the present invention relates to the fact that the bridge components are preferably constructed of corrosion resistant material which does not need the application of protective surface coatings. Such materials are commercially available. One of them, a copper bearing steel, is marketed under the trade designation COR-TEN by the United States Steel Corporation of Pittsburgh, Penn. Briefly, upon exposure to the atmosphere, these materials surface oxidize and form a self-protective coating, assuring that even after prolonged exposure to the atmosphere the integrity of the underlying metal will remain. Accordingly, by constructing a bridge from such corrosion resistant materials, thinner cross-section materials can be employed. Such thinner materials in turn are more readily worked and enable one, for example, to corrugate the web members from flat sheet metal stock of thicknesses of no more than 0.25 inch for most applications since the heretofore necessary "safety thicknesses" to protect against undetected corrosion can be greatly reduced or eliminated. The thinner crosssection, however, allows one to form relatively inexpensive metal, such as flat sheet metal stock, into more intricate, stronger shapes, such as corrugated plate at relatively low cost.

Another aspect of the present invention relates to the manufacture and assembly of the bridge modules. In accordance therewith, the chord plates and the diagonal webs are formed by corrugating flat sheet metal stock and cutting the stock to the appropriate length for the chord plates and the webs. The web stock is then curved in the direction of the corrugations to generate the rounded crown sections by incrementally flow-forming the corrugated stock without causing it and in particular its relatively deep corrugations to buckle, crack or unduly stretch.

In accordance with one embodiment of the invention the actual forming of the curved sections is done by furnishing a pair of opposite, complementary concave and convex forming dies which have a profile that corresponds to the profile of the web corrugations. The dies have a curved length with a curvature radius corresponding to the desired curvature radius of the curved crown section of the web, the curved die length extending over an arc which is substantially less than, and normally only a fraction of the desired arc length of the crown section. The portion of the web stock to be curved is placed between the dies and the dies are forced against each other to flow-form and curve the webs. The dies are then moved apart and the webs are advanced in a direction parallel to the corruations by a distance no greater than the curved die length. Thereafter, the steps of forcing the dies against each other, moving them apart and again advancing the panels parallel to the corrugtions is repeated a sufficient number of times until the desired full arc length has been formed in the webs.

In accordance with another embodiment of the present invention, the forming of the curved crown sections is done by carefully stretch forming them over a mandrel having the required radius of curvature. Such a mandrel has a profile corresponding to the profile of the web, means for grasping the web to move it with the rotating mandrel, and a firm support for the portion of the web disposed on the side of the web opposite from the mandrel to assure an even, wrinkle-fre incremental stretch forming of the web to the exterior configuration of the mandrel.

The careful, incremental curving of the curved crown sections prevents extensive differential elongations between the inner and the outer corrugations from damaging the web as may occur as a result of an undue compression and buckling of the inner web corrugations. This might rupture load carrying portions of the webs and could seriously endanger the structural integrity of the bridge.

For practical reasons, conventional flow-forming of the web by subjecting it to flow-forming forces, e.g. by placing the web under a drop hammer is often not feasible because the relatively large dimensions of many webs would subject them to acceleration forces which can cause the permanent deformation of web portions not being deformed. The incremental flow-forming approach of the present invention however, yields excellent results, is relatively inexpensive and quickly performed, and has none of the drawbacks of other forming processes.

At a convenient point during the manufacturing process the necessary bolt holes are formed in the chord plates and web diagonals. Thereafter, the upper and lower chord plates are assembled with the web elements to define the above discussed bridge modulus. Whether or not the assembly takes place at the manufacturing plant, at a different assembly location or at the bridge site depends on the circumstances of each particular case. Frequently, it will be most desirable to assemble the modules at the manufacturing plant. However, in instances in which the moludes must be transported over long distances, it may be more economical to ship the components, that is the chord plates, the web diagonals and the load distribution ribs in stacked, space-saving form to a point closer to the bridge site to thereby reduce the required shipping space and shipping costs.

The actual assembly of the components is simple. The chord plates are positioned in overlying relationship, the bolt holes in the chord plates are aligned with the corresponding bolt holes in the webs and suitable fasteners, such as bolts are extended through the holes and fastened to complete the assembly operation.

Another important feature of the present invention is the actual size and shape of the corrugations. It is presently preferred that they have a pitch of approximately 16 inches and a corrugation depth of between about 5½ to 6 inches with a generally trapezoidal profile. As compared to other, relatively large corrugations, such as those discussed in U.S. Pat. No. 3,308,956, for example, the corrugations of the present invention provide substantially greater strength than that disclosed in the referenced patent even when the two are made from the same material.

For example, a finish corrugated panel having corrugations as provided by the present invention is relatively wider, that is it provides for an approximately 6 to 7% greater coverage than a panel corrugated from the same material in accordance with the referenced U.S. patent. Moreover, the much simpler profile of the corrugations in accordance with the present invention makes it possible to corrugate the panel from steel plate having a yield strength of as much as 50,000 psi without cracking, rupturing, etc. the material while the much more intricate corrugations of the referenced patent can only be made of steel having a maximum yield strength of about 30,000 psi to avoid cracking of the plate while it is being corrugated. As a result, by selecting higher strength steel plate, combined with the favorable corrugation form, the present invention achieves more than a 50% increases in the strength of the corrugated panels while the increase in the cost of the steel plate (because of its higher strength) is normally only in the order of a few percentage points.

DESCRIPTION OF THE PREFERRED EMBODIMENTS

Figure 1:
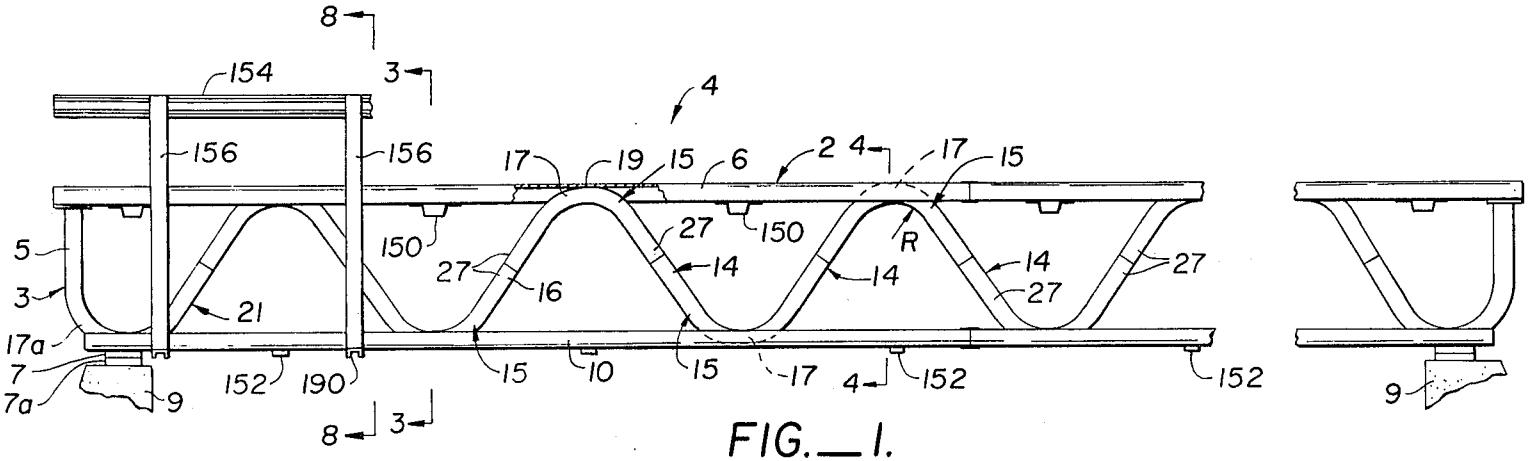
FIG. 1 is a side elevational view, with parts broken away, of a load carrying, modular bridge constructed in accordance with the present invention.
Figure 2:
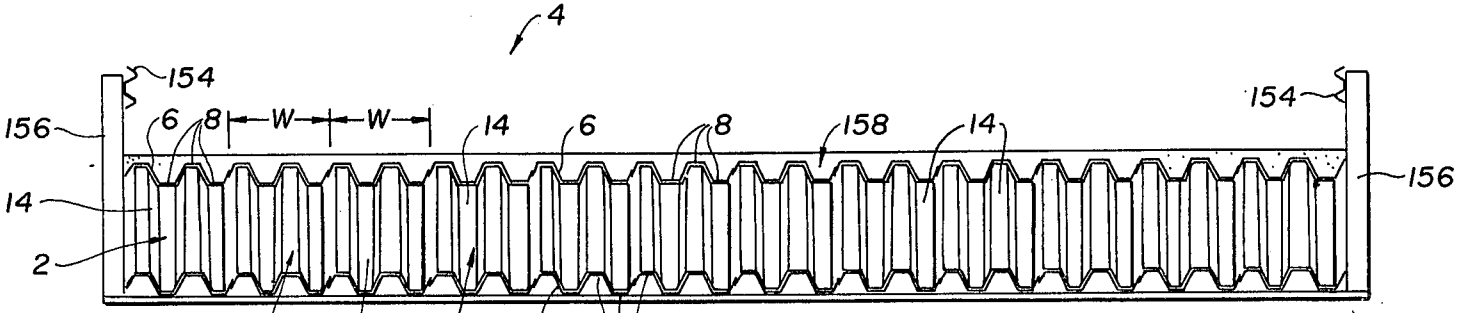
FIG. 2 is an end view of the modular bridge shown in FIG. 1.

Referring to FIGS. 1–2, several side-by-side, load carrying truss-deck bridge modules 2 of a bridge 4 constructed in accordance with the present invention are illustrated. Generally speaking, each module comprises an upper chord plate 6 that has a width "*w*" and a perpendicular length (not separately identified) and which is constructed of corrugated metal plate having longitudinally running corrugations 8. A second or lower chord plate 10 normally has a length equal to the length of the upper chord plate and a like width. Preferably it too is constructed of corrugated metal plate having longitudinally running corrugations 12. For particular applications, however, the lower chord plate, which is primarily subjected to tension, may be constructed of flat plate. Each module has a plurality of diagonally oriented webs 14 which are secured to the upper and to the lower chord plates and which have a width substantially equal to that of the chord plates as is hereinafter discussed in greater detail. The webs define an undulating or sinusoidal support 21 for the chord plates and they are generally defined by a series of normally straight, diagonally oriented center sections 16 which are interconnected by curved upper and lower web crown sections 17.

The webs, and in particular their center sections 16 are also constructed of corrugated plate having a plurality of side-by-side corrugations with a pitch equal to that of the chord plates. The crown sections 17 of the webs are suitably secured to the chord plate as with bolts or rivets 22. Since the webs have a width that is substantially equal to the width of the chord plates they support the latter at spaced intervals over its full width.

Figure 5:
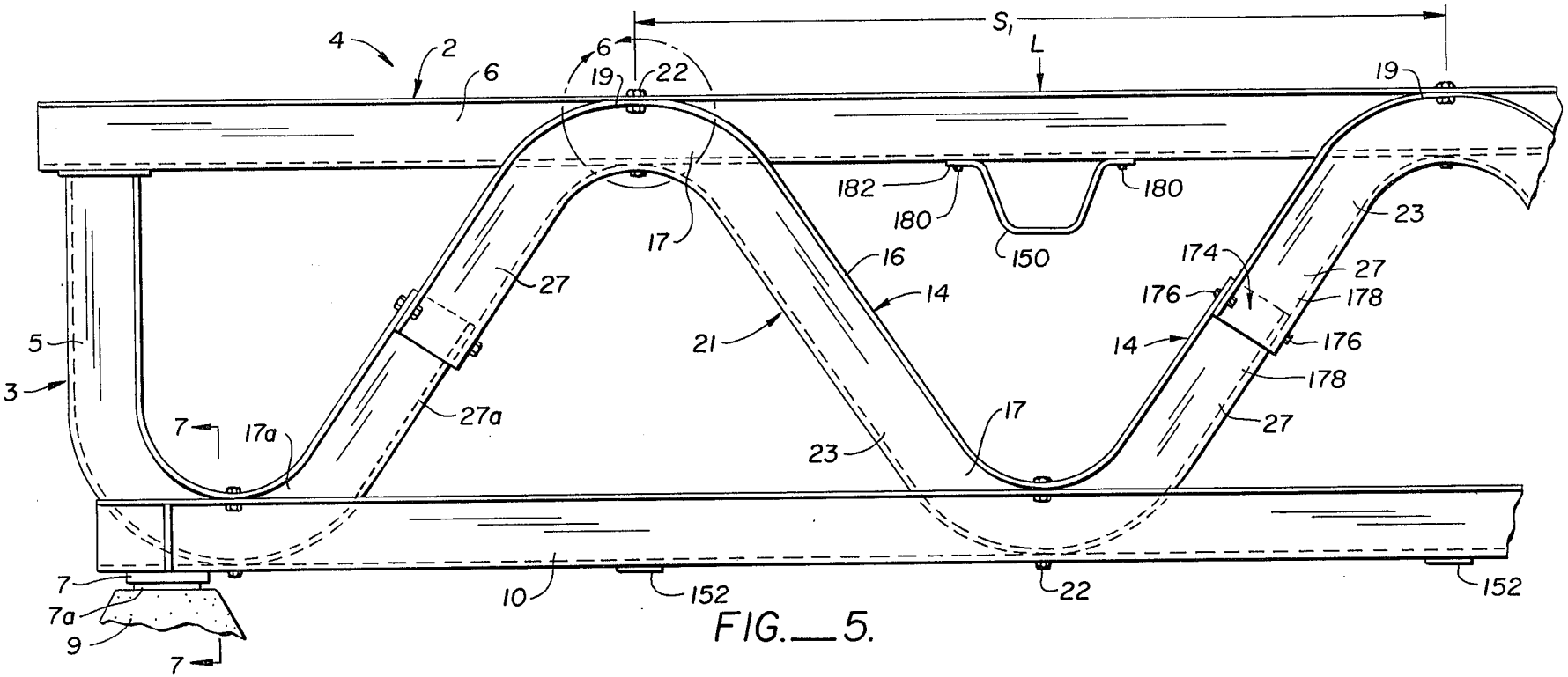
FIG. 5 is an enlarged, fragmentary side elevational view of the bridge shown in FIG. 1 and shows constructional details of the bridge.
Figure 7:
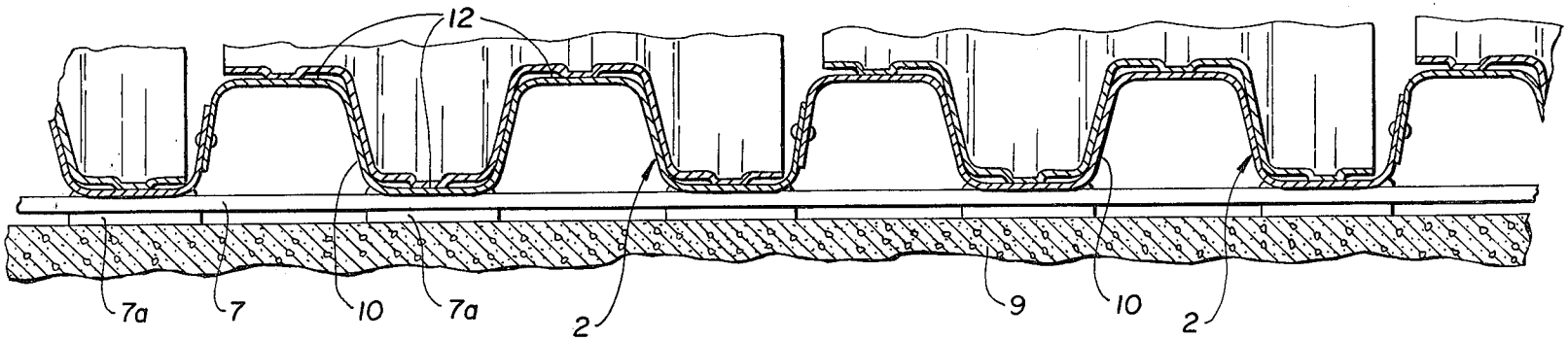
FIG. 7 is an enlarged fragmentary end view of the bridge shown in FIG. 5, with parts of the bridge deleted, is taken on line 7—7 on FIG. 5, and illustrates in greater detail the manner in which the bridge is supported.
Figure 14:
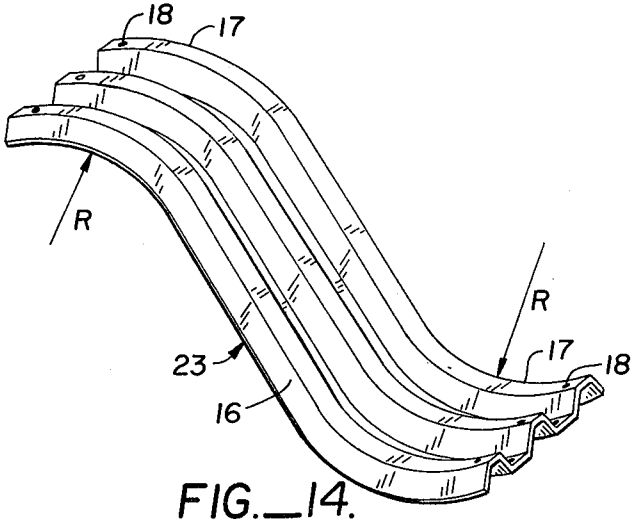
FIG. 14 is a perspective side elevational view of a load carrying, diagonal web constructed in accordance with the present invention.

The webs can be integrally constructed by sinusoidally shaping a relatively long length of corrugated plate, or they may be constructed by assembling a plurality of generally trough or L-shaped web elements 15 (as shown in FIG. 1) or Z-shaped web elements 23 (as shown in FIGS. 5 and 14) into support 21.

When web element 15 have the L-shaped configuration illustrated in FIG. 1, each web has a pair of angularly inclined, straight legs 27, which form the straight center section 16 when the web elements are assembled into support 21, and one almost semi-circular and continuously curved end or crown section 17 which interconnects the straight legs. In their assembled form the ends of legs 27 overlap and they are secured to each other with bolts, rivets or the like (not shown separately shown). Bolts 22 secure the top (or bottom center point 19 of the crown sections to the respective chord plates as shown in detail in FIG. 6.

Figure 1B:
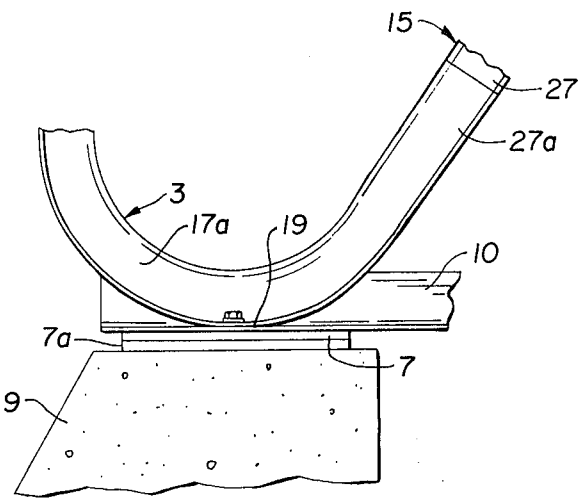
FIG. 1A-1B are side elevational, fragmentary views and show details of the construction and installation of the bridge shown in FIG. 1.
Figure 1A:
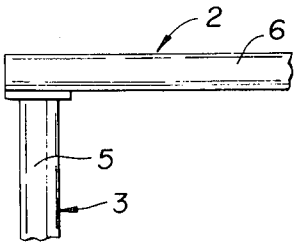

The ends of bridge module 2 are defined by generally J-shaped webs 3 each of which has a vertical leg 5 joined by a curved base section 17*a* that normally extends over an arc greater than the arc of crown sections 17 and which is also continuously curved. The base section 17*a* includes a center point 19 and terminates in a free leg 27*a* for connection to the leg 27 of the next web element 15 as best seen in FIG. 1B. Suitable bearing plates 7 support the underside of lower chord plate 10 on a bridge support or abutment 9. An elastomeric pad 7*a* may be interposed between the bearing plates and the bridge abutment. Suitable anchor bolts (not shown) or the like may be provided to securely mount the slab sections to the abutment while permitting thermal bridge elongations or contractions in a conventional manner.

Still referring to FIGS. 1–2, a sufficient number of bridge modules 2 are placed side-by-side to give the bridge the desired overall width. The bridge modules are tied together with a plurality of load distribution ribs 150 which are constructed as is more fully described below, which are disposed midway between adjacent attachment points 19 between diagonal support 21 and upper chord plate 6, and which are rigidly secured to the underside of each upper chord plate with bolts, rivets, welds, or the like. Although the load distribution ribs serve to securely tie the bridge modules to each other, their primary function is to effect a lateral distribution of the load and thereby a more uniform stressing of the upper chord plate under vehicular loads as is discussed in detail below.

The lower chord plates are tied to each other with tie bars 152 secured to the underside of the lower chord plates, running transversely thereof over the full width of the bridge, and being located midway between attachment points between the lower chord plate 10 and the lower crown sections 17 of support 21. Depending on the particular application the tie bars may be bolted, riveted, welded or otherwise securely fastened to the lower chord plates.

The bridge structure is completed by providing lateral guard rails 154 which run over the full length of the bridge and which are mounted to spaced apart upright posts 156 which in turn are secured to the two outermost bridge modules. Finally, a road bed 158 such as asphalt or concrete is applied over the top chords 6 of the assembled bridge modules 2 as is best illustrated in FIG. 2.

Keeping in mind the above summarized overall construction of a bridge in accordance with the present invention, the detailed provisions of the present invention which assure that the earlier summarized advantages are attained can be set forth in greater detail.

Referring now to FIGS. 1–5, it is of utmost importance that all component parts which makes up a bridge module routinely nest, that is that they require no special fitting and adjustment during assembly of the modules and their later installation. Further the module size, and in particular, the module width "*w*" must be selected so that it facilitates the transport of the modules even over narrow, twisting highways and the like, so that the width is compatible with available materials, and so that it utilizes the materials in an optimal manner. This latter aspect requires that material waste be minimized or, preferably, eliminated and that the material be structurally used in the most efficient manner.

In view of presently available materials, approximately 52 inch wide flat sheet metal strip is a preferred raw material for forming the corrugated plate and then fabricating it into the bridge modules. In accordance with the invention the 52-inch wide strip is corrugated into a plate having an effective width of about 32 inches, trapezoidal corrugations that alternatingly terminate in substantially horizontally disposed corrugation peaks and troughs or valleys 162, 164 (FIG. 4) a corrugation pitch "P" of about 16 inches, and a corrugation depth "D" of about 6 inches. The finish corrugated, initially 52 inch wide strip thus has two full corrugations and yields bridge modules 2 having an effective width "*w*" of 32 inches, that is 2 ft. 8 ins. The actual width of the corrugation plates and of the bridge module is slightly, e.g. ½ inch to 1 inch larger to allow for an overlap between the lateral sides of the chord plates of adjacent modules.

Figure 4:
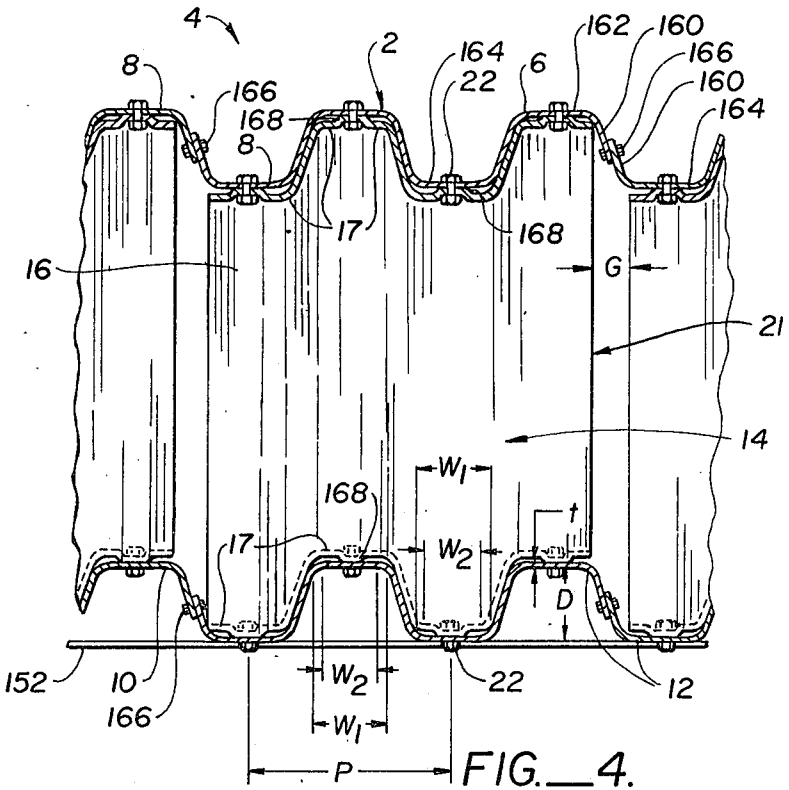
FIG. 4 is an enlarged, fragmentary end view, in section, similar to FIG. 3 and is taken on line 4—4 of FIG. 1.
Figure 3:
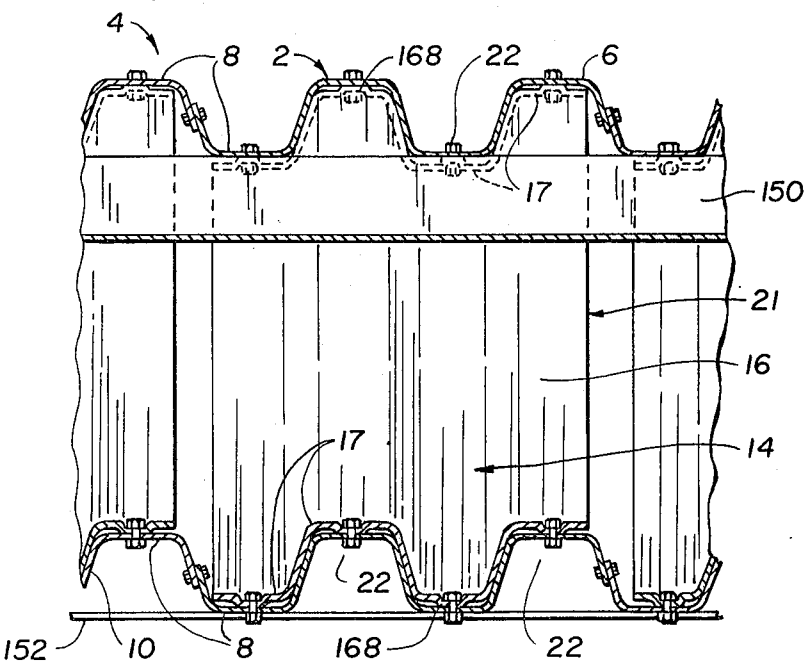
FIG. 3 is an enlarged, fragmentary end view, in section, and is taken on line 3—3 of FIG. 1.

The sheet is further corrugated so that a finished corrugated panel terminates laterally in slanted sides 160 (see FIG. 4) which interconnect corrugation peaks 162 and corrugation valleys 164. In this manner, the slanted corrugation sides 160 overlap when the bridge modules are erected side-by-side and they can be readily interconnected with spaced apart bolts 166 which are preferably placed on the neutral axis of the slanted sides as is illustrated in FIG. 4, for example, at a lateral bolt center spacing of 32 inches and a longitudinal bolt spacing of approximately 12 inches on center.

To effect the proper seating between the upper and lower chord plates 6, 10 and the upper and lower crown sections 17 of sinusoidal support 21 it is normally necessary to take into consideration the material thickness "*t*" of the chord plates and of the diagonal webs 14. In accordance with one embodiment of the invention, the corrugations are formed so that the base width "W1" and "W2" of the corrugation peaks and valleys 162, 164 alternatingly differ. In the presently preferred embodiment of the invention the difference between W1 and W2 is one plate thickness "*t*" so that the corrugation peak and valley base widths of each panel alternatingly differ by approximately the material thickness of the panel. As a practical approximation the base widths may, for example, differ by 3/16 inch, which can accommodate the nesting of panels having material thicknesses of ¼ inch to ¼ inch, ¼ to 14 gauge, or 14 gauge to 14 gauge. The corrugation pitch "P" and depth "D", however, remain unchanged.

Figure 6:
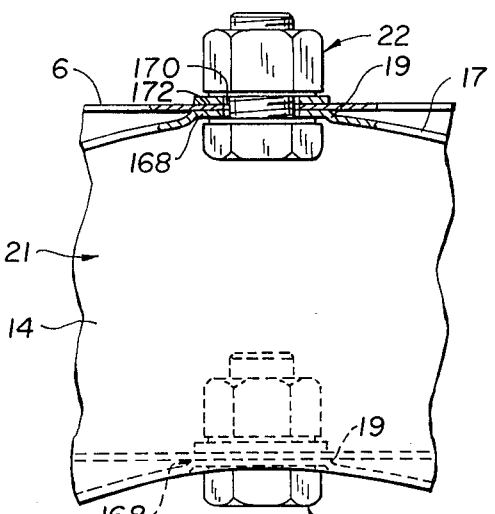
FIG. 6 is an enlarged, side elevational, fragmentary view, in section, of the portion of FIG. 5 indicated by circular line 6.

Alternatively, and referring momentarily particularly to FIG. 6, one of the corrugated plates and the web elements, say crown sections 17 of the latter may be provided with raised bosses or dimples 168 which have a generally circular configuration and which are located at top (or bottom) centers 19 of the crown section. Bolt holes 170 for threaded bots 22 are concentrically formed in the raised bosses. Each boss is raised from the curved periphery of the crown section a distance so that the mating surface 172 of the boss securely engages the opposing surface of the chord plate when bolt 22 is tightened to assure a firm friction connection between the two. In a practical embodiment of the invention in which the chord plate and the webs are constructed of a material having a thickness of ¼ inch, the boss projects past the curved periphery of the crown section 5/16 inch.

Under certain circumstances, it may be preferable to substitute curved washers (not shown) for the bosses. The washers are then placed between the chord plate and the crown section and upon tightening of the bolt the desired friction connection is established.

In the embodiment illustrated in FIG. 5, the web elements 23 have a generally Z-shaped configuration and each defines one complete undulation of support 21. It is intended to be illustrative of the various web element configurations above discussed and the earlier described L-shaped web elements can, of course, be substituted.

Referring now again to FIGS. 1–5, in instances in which the corrugations are constructed with the alternating base widths "W1" and "W2", the connection between adjoining legs 27 of serially arranged web elements 23 is as illustrated at 174 in FIG. 5. No special preparation of the web element ends is required and they are readily secured to each other with bolts 176 or the like. However, in instances in which the corrugations are uniform, that is in which all base widths are alike and the crown sections are provided with the above-discussed bosses 168, overlapping ends 178 of legs 27 are inserted into expansion dies placed in a suitable press or drop hammer such as are commercially available from the Chambersburg Engineering Co. of Chambersburg, Pa., under the trade designation CECOSTAMP, to provide the overlapping ends with differing, alternating base widths as above discussed to assure the proper seating of the panels. Thus, in such instances, the corrugations of the webs are uniform throughout their length except for the local relative expansion and contraction of the overlapping web ends 178. These web ends are secured to each other as above described with bolts 176 or the like shown in FIG. 5.

Still referring to FIGS. 1–5, to facilitate the erection and interconnection of bridge modules 2 while assuring a nesting of all interconnected parts without undue manufacturing difficulties, it is presently preferred to construct the web elements 15 (or 23 as shown in FIGS. 5 and 14) so that their overall width is slightly less than the overall width of chord plates 6, 10. For example, when the chord plates have an effective width of 32 inches the web elements may be given an overall width of 29 to 30 inches so that they are laterally recessed a distance of 1 to 1½ inches from the lateral edges of the chord plates. Upon the installation of the bridge module, a gap "G" is formed between opposing edges of the web elements and the sinusoidal supports 21 of the adjacent modules as is best shown in FIG. 4. The advantage of this construction is that an accumulation of four material thicknesses at the top and bottom centers 19 of crown sections 17 is avoided. Such an accumulation would require the modidication of the corrugations to assure nesting and is therefore undesirable. For reasons more fully discussed hereinafter the deletion of a firm connection between the side edges of the diagonal webs 14 does not noticeably affect the strength and rigidity of the bridge modules 2 and the overall bridge 4, even though that may initially appear to be the case.

As an alternative to constructing the diagonal webs 14 slightly narrower than the width of the chord plates the former may be constructed so that they have the exactly same width as the chord plates. As a result, the lateral, inclined corrugation sides (not shown in the drawings) of the web elements 15 (or 23, FIGS. 5 and 14) overlap in the same manner in which the corresponding corrugation sides 160 of the chord plates overlap so that the former can also be secured, e.g. bolted together. To avoid the accumulation of four material thicknesses in the vicinity of top (or bottom) centers 19 of the crown sections 17 the respective corrugation sides may be suitably removed at the upper and lower crest of each crown section so that they there form a discontinuity and do not overlap.

Referring now to FIGS. 1, 2, 5, 9 and 29, it was earlier discussed that vehicular loads are concentrated at relatively isolated, spaced apart points of the bridge which move along the bridge as the vehicle moves thereover. The bridge must be designed to accommodate such concentrated moving loads. Particular requirements are placed, however, on the bridge deck since the deck is the member of the bridge to which the vehicular loads are actually applied. Generally speaking, the bridge deck is supported at spaced apart points by the remainder of the bridge, in the past by the girders and trusses that underlie and carry the deck. In the present invention, the bridge deck simultaneously defines the upper chord plates of the longitudinal bridge trusses and the upper chord plates must have sufficient strength and rigidity to adequately support vehicular loads in accordance with AASHTO standards. From a brief review of FIG. 5 it will be apparent that vehicular loads, such as load "L" acting on the upper surface of the upper chord 6 causes maximum stresses in the upper chord plate when "L" is midway between web attachment points 19. At that location the upper chord plate exhibits the greatest unsupported span, that is the above-referenced web spacing "S1".

The construction of the upper chord plate 6 with its longitudinally running corrugations 8 exhibits a high degree of rigidity in a longitudinal bridge direction. Accordingly, top chord 6 acts as a continuous beam of span "S1" (between attachment points 19) to transfer load "L" to the attachment points. However, the upper chord plate exhibits little rigidity and strength in a lateral direction of the bridge so that there is little distribution of load "L" to either side of its application point. To enhance the lateral load distribution and to thereby provide appreciably more width to the above discussed continuous beam so that the chord plate is more efficiently used from a structural point of view, the earlier discussed load distribution ribs 150 are provided.

The ribs are installed midway between adjacent web attachment points 19 and they have a generally U-shaped configuration, as is best shown in FIG. 5, and preferably they have a trapezoidal profile corresponding to that of the chord plates and of webs 14. Suitable fastening means such as bolts 180 secure flanges 182 of each rib to the underside of the upper chord plate only, that is the load distribution rib is not otherwise connected with any other structural, load bearing component of the bridge or of the bridge module.

The dimensioning of the load distribution rib is of importance to assure that it properly distributes the load in lateral directions while minimizing the additional weight added to the overall bridge. In accordance with the present invention, the load distribution rib is dimensioned by first ascertaining from the design standards of AASHTO the maximum permissible lateral load distribution width. According to these design standards the maximum lateral distribution width "S*w*" is presently limited to 7 feet and may be less than that as a function of the web spacing "S1" of the bridge. Once the maximum permissible distribution width "S*w*" has been ascertained, and with the vehicle load "L" known, the load distribution rib is dimensioned by determining its moment of inertia I as follows:

$$I = k \cdot I_l \frac{S^4}{S_1^3} \text{ (in}^4\text{) wherein}$$

$k$ = a constant in the range of between about 2 and 120 and further is a factor of $(L'/L) \cdot (S/12)$ with L being the vehicular wheel load (in lbs.) and $L' = L/Sw$ (in lbs. per ft. width of the top chord plate);

$I_1$ = the average moment of inertia of the corrugated upper chord plate per inch width (in in$^4$);

$Sw$ = the lateral bridge width over which "L" is to be distributed (in ft.);

$S_1$ = the web spacing (in inches); and

S = the spread of L over a given width of the upper chord plate (in inches) due to the effective height of the upper chord plate (including road bed 158) and the width of vehicle tires. It is determined from the applicable AASHTO design standards.

Figure 29:
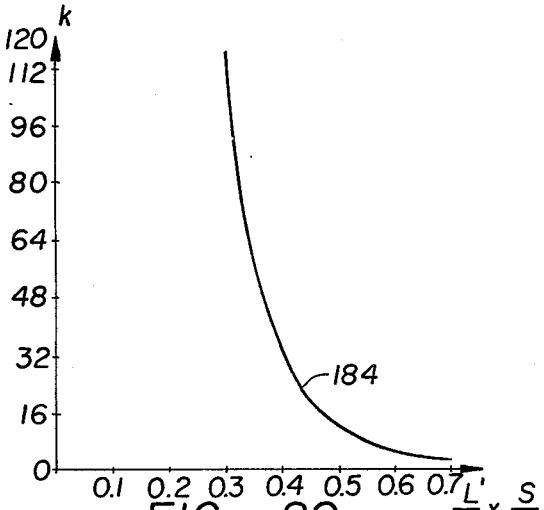
FIG. 29 is a diagram which is useful for determining the characteristics of a load distribution rib constructed in accordance with the invention.

The factor "$k$" is directly read off curve 184 on the vertical axis of FIG. 29 upon determining $(L'/L) \cdot (S/12)$ which is readily calculated since it comprises known parameters.

From "I" the load distribution rib can be conventionally dimensioned.

The load distribution rib constructed as above discussed effectively spreads the vehicular load "L" over a significant lateral width of the bridge, thereby reducing stress concentrations in the upper chord plate and rendering the bridge in general and upper chord plate in particular structurally more efficient. This means that for a given chord plate dimension and material a greater vehicular payload can be accommodated. Conversely, for a given vehicular payload the upper chord plate can be constructed of thinner material than would otherwise be the case.

In this connection, it should also be observed that the upper crown sections 17 of sinusoidal web support 21 have a similar effect on the stressing of the upper chord plate 6 as do the load distribution ribs 150 although they differ therefrom to the extent that the upper crown sections are not only secured to the underside of the upper chord plate but they are further supported by the lower chord plate and they further distinguish by the fact that they form an integral structure with both chord plates. Nevertheless, the effect of the upper crown sections on the actual stressing of the upper chord plate on the vehicular loads is similar to that of the load distribution ribs.

The upper crown sections 17 effectively act as a load distribution rib for the upper chord plates even though they are not continuous since the lateral edges of the webs of each bridge module 2 are separated from the corresponding web edges of the adjacent modules by the earlier discussed gap "G". However, in relative terms, gap "G" is sufficiently small so that the intervening, unsupported 1½ inch to 3 inch portions of the upper chord plates become rigid and vehicular loads are transferred through shear forces across gap "G" from one bridge module to the next and thereby from one crown section 17 to the laterally next adjacent one.

From the preceding, two things are apparent. First, the load distribution ribs substantially increase the effective width of the upper chord plate 6 which carries, i.e. which is stressed by a vehicular load, thereby reducing stresses in the plate and structurally more efficiently utilizing it. Similarly, the substantially continuous support of the upper chord plates over their entire width by the upper crown sections of sinusoidal web support 21 causes a similar distribution of the vehicular load in a lateral bridge direction. Such would not be the case in instances in which the bridge deck is supported by spaced apart, longitudinally running girders and the like as was the case in common, prior art bridge structures.

A lateral load distribution is also achieved when road bed 158 is rigid such as when it comprises a layer of concrete. By mechanically anchoring such a concrete road bed to the underlying upper chord plate 6 a lateral load distribution effect is achieved. Accordingly, when the road surface comprises poured-in-place concrete the upper chord plate may be provided with intermittent outwardly and inwardly extending protuberances 186, which may be punched, stamped, pressed or the like into the chord plate. When the concrete is poured, the protuberances form corresponding depressions in the concrete which generate the desired mechanical interlock between the chord plate and the concrete road bed 158. When subjected to vehicular loads the mechanical interlock between the two causes a limited lateral load distribution. It should be noted, however, that this approach is a less desirable alternative to the above discussed load distribution ribs 150 since it results in a significant weight penalty and a relatively lesser effective lateral load distribution.

Figure 8:
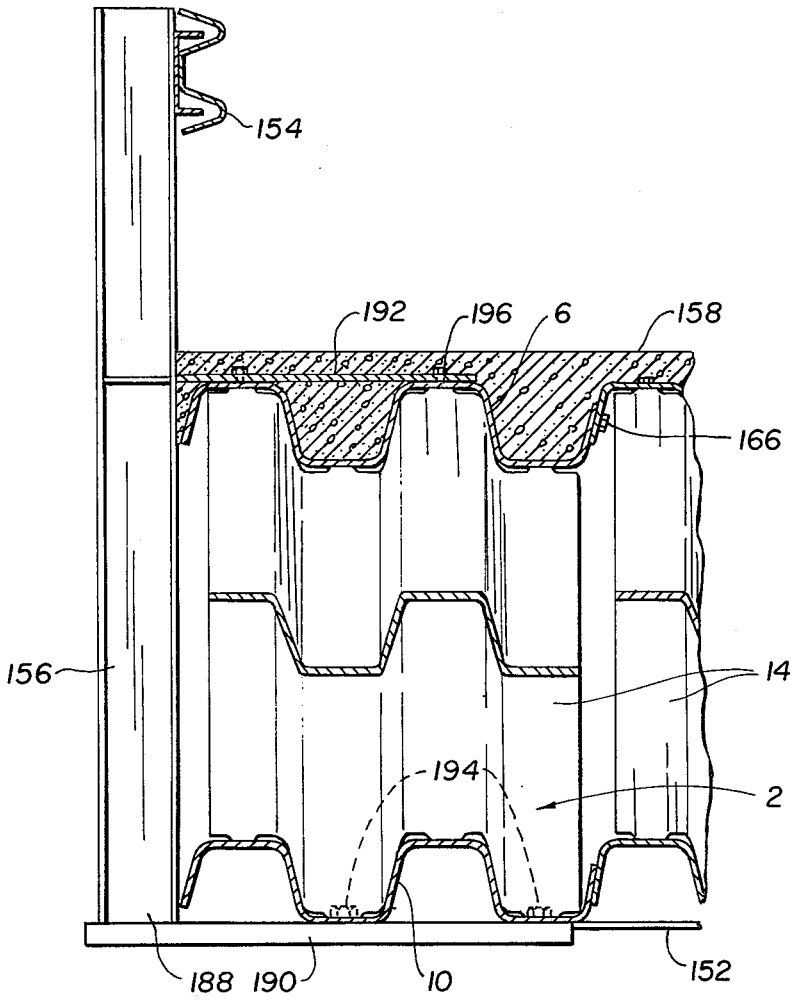
FIG. 8 is a side elevational view, in section, of the bridge and is taken on line 8—8 of FIG. 1.
Figure 9:
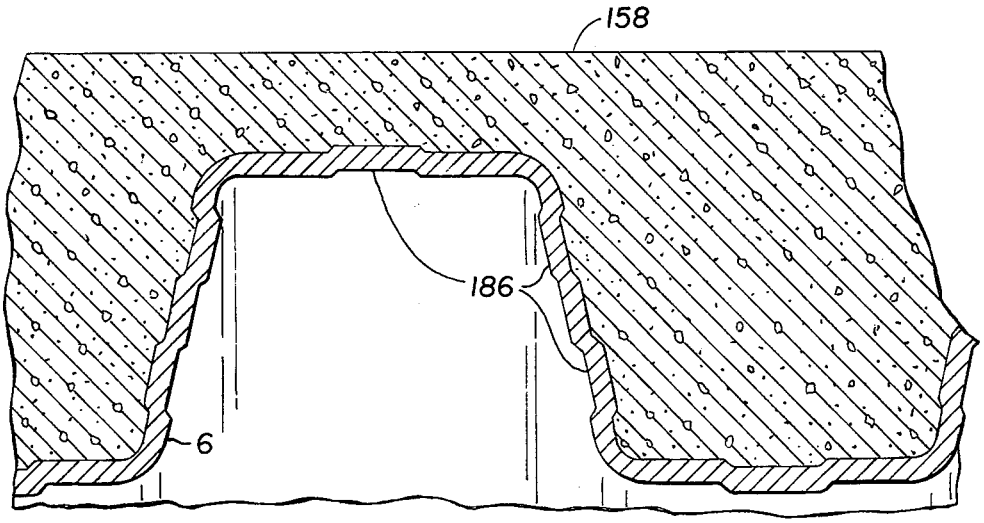
FIG. 9 is an enlarged, fragmentary elevational view, in section, of the upper chord plate of the bridge and a manner for mechanically interlocking a relatively rigid road bed with the upper chord plate.

Referring now to FIGS. 1, 2 and 8, the upright posts 156 which mount the lateral safety guard rails 154 protrude the necessary distance, e.g. 27 inches above road bed 158. They have a sufficient length, however, so that their lower ends 188 are flush with the underside of lower chord plates 10. An inwardly extending channel 190 is welded to the lower end of each post and has a length so that it can be securely attached to at least two corrugation valleys of the lower chord plate by bolting, riveting or welding it to the lower chord plate. A tie plate 192 is disposed on top of upper chord plate 6, is secured, e.g. welded to the appropriate intermediate point on post 156 and has a sufficient length so that it too can be securely attached to at least two corrugation peaks of the upper chord plate with bolts 196 or with rivets, welds or the like (not shown).

The connection of the channels 190 and the tie plates 192 to at least two corrugations substantially increases the strength and rigidity of the post-to-bridge connection. When desired stiffener plates (not shown) may be welded between adjacent corrugations so that the channel and tie-plate lengths can be reduced while still effectively connecting the posts to two corrugations. This alternative has the advantage that the channels and tie plates are less likely to be damaged during shipment and installation.

Referring now briefly to FIGS. 5 and 14, the diagonal webs 14 (shown in FIG. 5) defined by sinusoidal chord plate support 21 (FIG. 5) may be constructed of a variety of web elements, such as Z-shaped web elements 23 which have the earlier described straight, diagonally oriented center section 16 disposed intermediate continuously curved upper and lower crown sections 17 having a radius "R". The Z-shaped web members may be as illustrated in FIG. 5, that is so that straight ends 27 extend from the end of the curved crown sections, in which case the web element defines one complete sinusoidal undulation of support 21. Alternatively, the curved crown sections 17 of the web elements may be relatively shortened so that they extend just past the center 19 of the crown section (FIG. 14) in which event the web element 23 defines only half a sinusoidal undulation of support 21. Bolt holes 18 shown in FIG. 14 coincide with the center points of the crown sections and serve to fasten adjacent web elements 23 to each other and to the upper chord plates with bolts 22 (not shown in FIG. 14) The determination as to which web element is to be used on a given bridge to a large extent depends on the available manufacturing facilities, whether or not the bridge modules are shipped from the plant in their assembled form or as individual components and the like.

Figure 27:
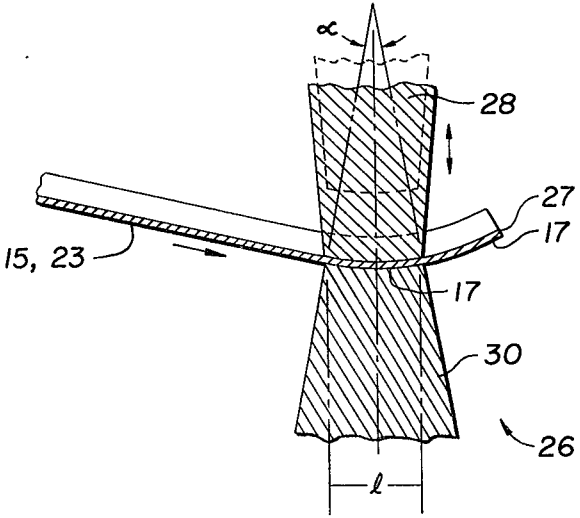
FIG. 27 is a schematic elevational view illustrating one embodiment of the present invention for incrementally curving the corrugated bridge webs.

Referring now to FIG. 27, web elements 15 or 23 (FIGS. 2, 14) are constructed by initially corrugating sheet metal stock in an appropriately designed corrugator, preferably a corrugating mill (not shown). Either before or after the corrugation operation, the sheet metal is cut to size so that the corrugated panel has the desired overall length and width of the web element as above described.

Next, the curved crown sections 17 are generated in accordance with the present invention by incrementally flow-forming the affected web portions. In accordance with one embodiment of the invention, this is done under a drop hammer 26 such as the above referred to CECOSTAMP.

The drop hammer is fitted with upper and lower dies 28, 30 which have the same profile as corrugated web elements 15, 23 and which have a curvature in the direction of the corrugations which equals the desired curvature of the crown sections.

The length of the dies in the direction of the corrugations is only a fraction of the finished arc length of crown sections. Frequently, the arc length "*l*" of dies 28, 30 is only between about 2 to about 3 inches, or an arc angle "$\alpha$" of between about 2°–5° for a radius "R" (see FIG. 14) of 12 inches.

The actual forming of the curved transition requires that the upper die 28 is first raised (to the position shown in FIG. 27 in dotted lines) and the panel is inserted between the dies so that one of the end sections, say upper end section 18 of the web protrudes from one side of the dies, the right-hand side as illustrated in FIG. 27, while an initial, say two inch long portion of the crown section 17 is disposed between the dies. The remainder of the web protrudes to the left, as seen in FIG. 27.

The dies are forced, e.g. impacted against each other, thereby flow-forming an initial two inch long portion of the crown section. The intensity of the blow exerted by the dies causes the metal to flow into conformity with the (curved) die length without rupturing or tearing as can otherwise be the case when curving deep profiles. Moreover, the small arc length that is formed during each hammer blow exerts relatively small acceleration forces to the web portion protruding to the left (as seen in FIG. 27) from the dies so that a buckling of the web due to such forces is prevented. To further reduce and substantially eliminate all significant acceleration forces, it is preferred to position the long length of the web protruding from the dies (to the left as shown in FIG. 27) at an inclination which approximates the inclination of the panel after an arc length "*l*" is formed.

For Z-shaped elements 23 (FIGS. 5 and 14) the other curved crown section of the element is formed in the same manner as described above.

Another embodiment of the present invention contemplates to stretch-compress form the web elements to generate the curved crown sections 17. This stretch-compress forming is incrementally performed by providing a mandrel having an exterior profile which corresponds to the profile of the web element corrugations.

One end of the sheet is securely, e.g. hydraulically clamped to the mandrel and the mandrel is slowly rotated about is axis. Another, travelling but flat support plate, which also has a profile corresponding to the profile of the corrugated sheet, is placed on the side of the sheet opposite from the mandrel and moves with the sheet as the mandrel is rotated so that flat portion of the sheet is maintained flat and fully supported to thereby prevent the formation of wrinkles in the metal as it is being stretch-compress formed.

From the preceding description of the present invention it should be apparent that the rigid interconnection of the chord plates and of the webs forms slab-like bridge modules 2 that have upper and lower, essentially planar (except for the unevenness caused by the plate corrugations 8 and 12) surfaces. Instead of being filled solid with material such as concrete, the webs define relatively thin and lightweight support members that effectively span the entire width of the bridge as defined by the combined width of all bridge modules 2. This provides the advantage of an even force distribution over the full bridge width as is attained with "solid" concrete structures without incurring the weight penalty inherent in such structures. Similarly, the disadvantages of high stress concentrations as well as the possibility of lateral instability (unless lateral stiffening members are utilized) encountered on bridges employing deck supporting, extruded or fabricated beams are thereby eliminated. Weight savings of as much as 40% and more as compared to such prior art bridge constructions are thereby attained. This material savings translates into similar cost savings which are further enhanced by the simple manner in which the few components, to wit the upper and lower chord plates and the connecting web elements, are constructed. Furthermore, a bridge constructed in accordance with the present invention can be inexpensively erected since the modules 2 can be pre-assembled at the factory or a convenient assembly point. Thereupon the whole assembly can be shipped to the construction site and hoisted onto the bridge supports with relatively lightweight cranes or other hoisting equipment. Upon the anchoring of the sections to the supports, the bridge, except for the road bed 158, is completed and ready for use.

Figure 10:
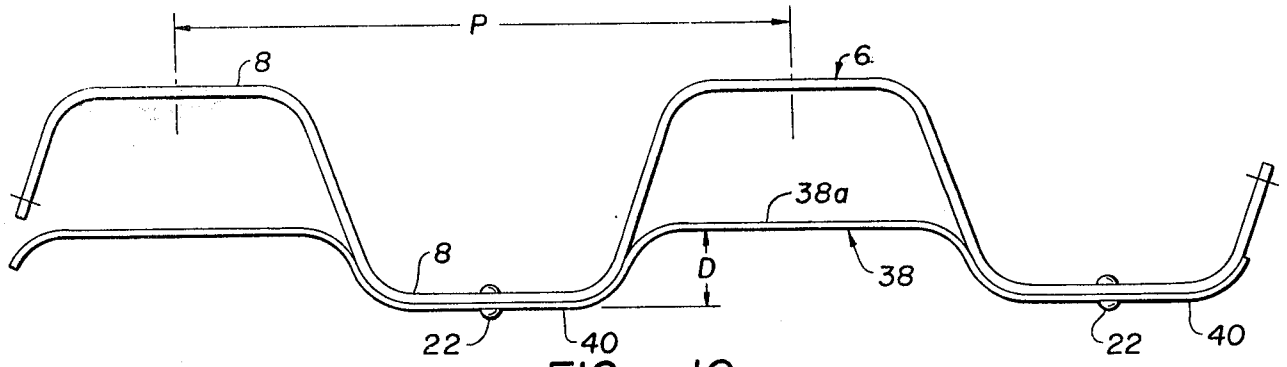
FIGS. 10–12 are enlarged, fragmentary, views and illustrate alternative manners for constructing and interconnecting the bridge deck and the load supporting web upper chord plate and the load supporting web elements.

Referring now to FIG. 10, in another embodiment of the present invention the chord plates (only upper chord plate 6 is shown) are constructed as previously described. They are interconnected with webs 38 that are also constructed of corrugated plate with a corrugation pitch "P" equal to that of the chord plates. However, the corrugation depth "D" of the web is less, say two inches for a 6 inch corrugation depth for the chord plate so that only alternating corrugations 40 nest with aligned chord plate corrugations. The chord plates and the webs are secured to each other as above-described with fasteners 22. This construction has the advantage that raised bosses (as illustrated in FIG. 6) are not needed in the crown 38*a* of the corrugation to assure a proper nesting of the corrugations. This embodiment is particularly useful for applications in which the webs are not highly stressed so that the greater corrugation depth is not necessary for an adequate strength.

Figure 11:
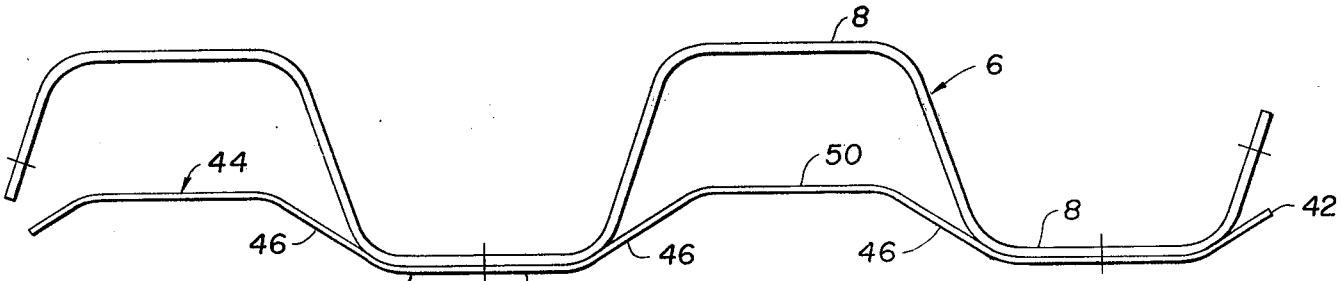
Figure 12:
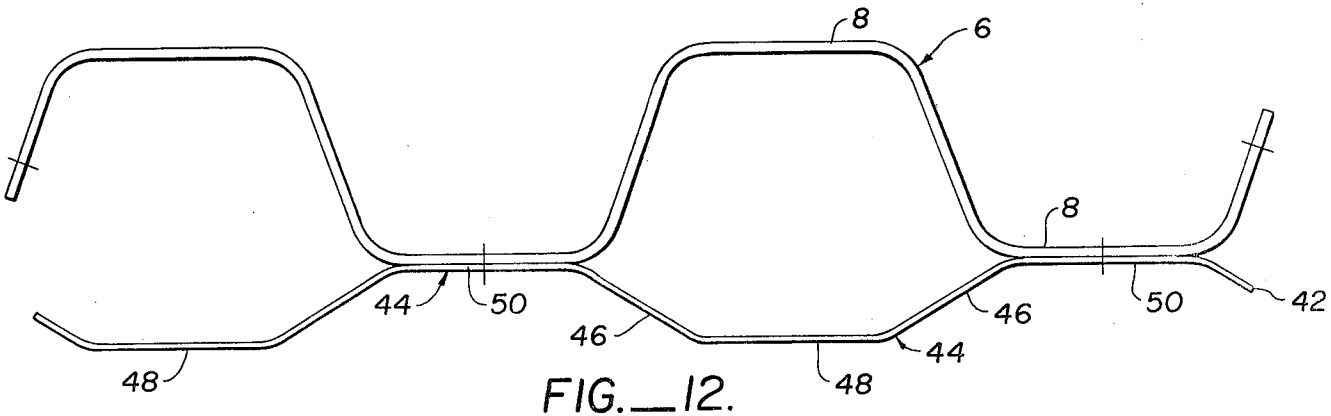

FIGS. 11 and 12 show alternate constructions for a web 42 in which the web corrugations 44 again have a lesser depth than the chord plate corrugations 8. Moreover, the web corrugations have a slightly different profile, the difference being primarily the provision of angularly more inclined corrugation sides 46 between the corrugation valleys 48 and peaks 50. The difference between the constructions shown in FIGS. 11 and 12 lies in the fact that in the former the respective corrugation troughs and peaks of the chord plate and the web are nested while in the latter the corrugation troughs and peaks oppose each other so that no nesting takes place and the profiles of the chord plates and the webs may diverge more widely.

Figure 13:
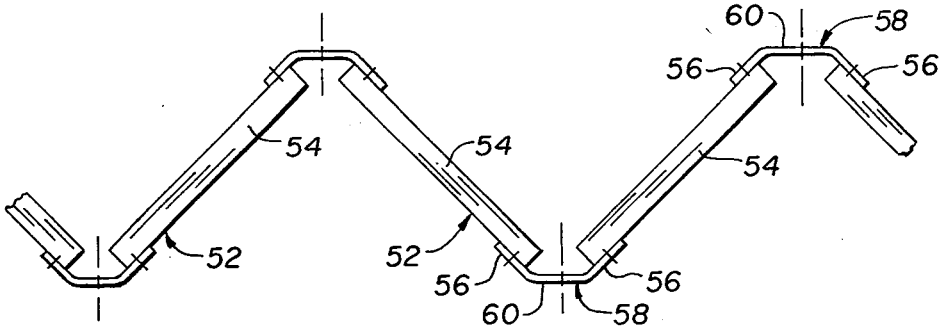
FIG. 13 is a fragmentary, side elevational view and illustrates another embodiment of the present invention.

Referring now to FIG. 13, in another embodiment of the present invention, a sinusoidal support 52 which interconnects upper and lower chord plates (not shown in FIG. 13) is assembled from a plurality of substantially flat, corrugated web center sections 54, the ends of which are attached, e.g. bolted, riveted or welded to angularly inclined side flanges 56 of a generally U-shaped connector 58. A base 60 of the connector is secured, e.g. bolted, riveted, welded or the like to the opposing surfaces of the upper and lower chord plates. This construction is advantageous for use in instances in which the above-discussed flow-forming equipment for forming the curved transition between the web center section and the adjoinng, horizontal end sections is not available. It requires additional manufacturing operations, fasteners, and the like and generally is of somewhat lesser strength so that it is more usable for where the encountered loads are relatively low. In this instance, the U-shaped connector can be as long as the full width of the bridge thereby also acting as a continuous load distribution rib as described above.

Figure 16:
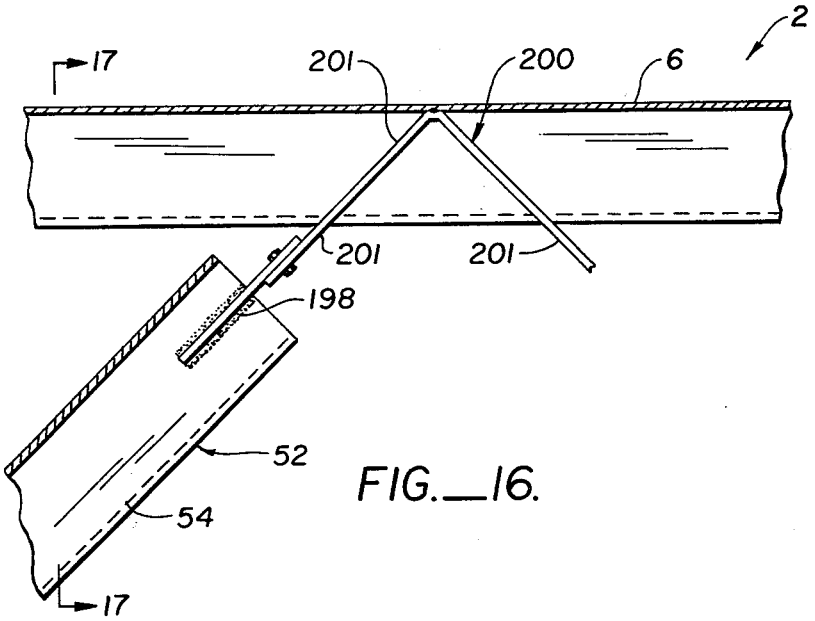
FIG. 16 is a fragmentary, side elevational view of a load carrying, diagonal web constructed in accordance with another embodiment of the present invention.
Figure 17:
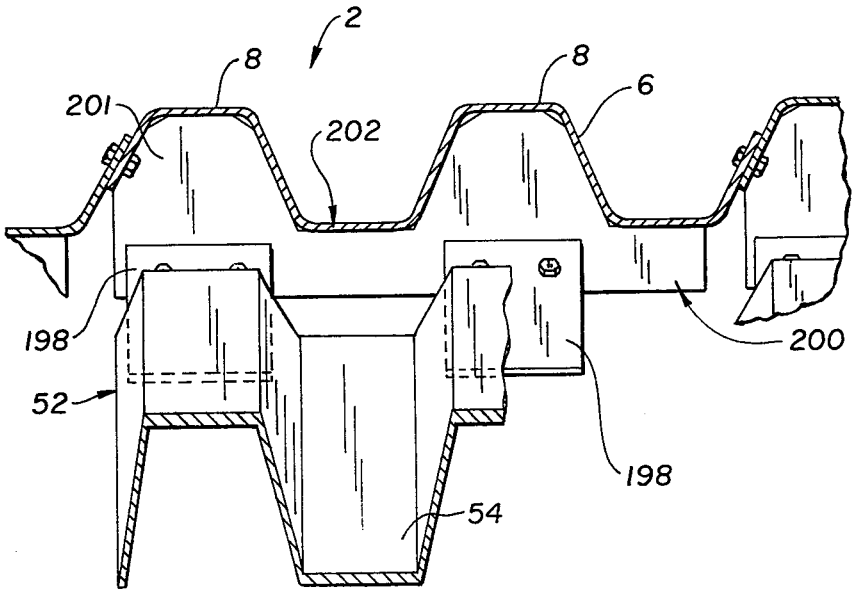
FIG. 17 is a fragmentary, front elevational view and is taken on line 17—17 of FIG. 16.
Figure 18:
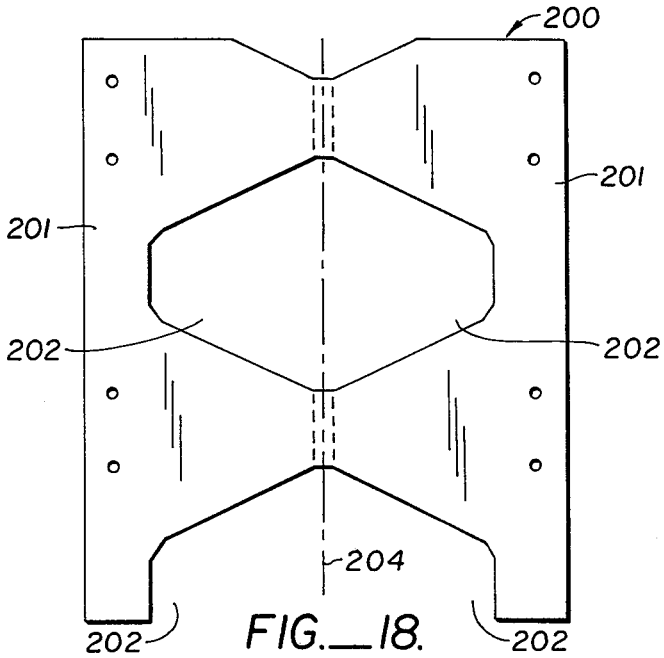
FIG. 18 is a plan view of the member shown in FIG. 16 which connects the diagonal web with the chord plates.

Referring momentarily to FIGS. 16–18, in an alternative embodiment of the present invention to that shown in FIG. 13 the sinusoidal chord plate 52 is constructed of a plurality of the same substantially flat, corrugated web center sections 54 as are shown in FIG. 13. Tie plates 198 are welded to ends of the center sections, protrude therefrom, and are secured to a gusset plate 200 defined by two perpendicular legs 201. The gusset plate has a width about equal to the width of bridge module 2 and includes generally trapezoidal cutouts 202 (as illustrated in FIG. 18) so that the legs 201 of the gusset plate substantially nests in the corrugations 8 of the upper chord plate 6 to facilitate welding the gusset plate to the chord plate. FIG. 18 illustrates the blank from which the gusset plate is made, shows the cutouts 202 which may be stamped, burned or otherwise removed from the plate while it is flat, and a center line 204 about which the blank is subsequently bent 90° to define the perpendicular legs 201.

Figure 19:
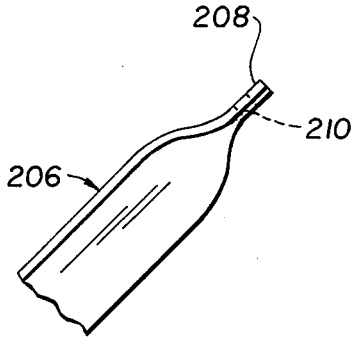
FIG. 19 is a fragmentary, side elevational view of the end of a diagonal web constructed in accordance with another embodiment of the invention for use in the web-to-chord plate connection shown in FIG. 16.

FIG. 19 shows an alternative corrugated plate web center section 206 which can be used in connection with the gusset plate 200 mounting shown in FIGS. 16 and 17 or, for that matter with the U-shaped connector 58 illustrated in FIG. 13. Web center section 206 has a length about equal to the combined effective length of web section 54 and tie plates 198 in FIGS. 16 and 17. Its ends 208, however, are flattened by placing the corrugated plate under a suitable press and they are provided with appropriately placed bolt holes 210 so that the section can be bolted to the legs 201 of gusset 200. This alternative construction has the advantage of requiring less welding and being therefor more economical than the manner of securing the center section to the gusset plate as is shown in FIGS. 16 and 17 but requires the appropriate corrugation flattening equipment. In all other respects, the two alternatives are compatible with each other and of substantially equal effectiveness.

Figure 20:
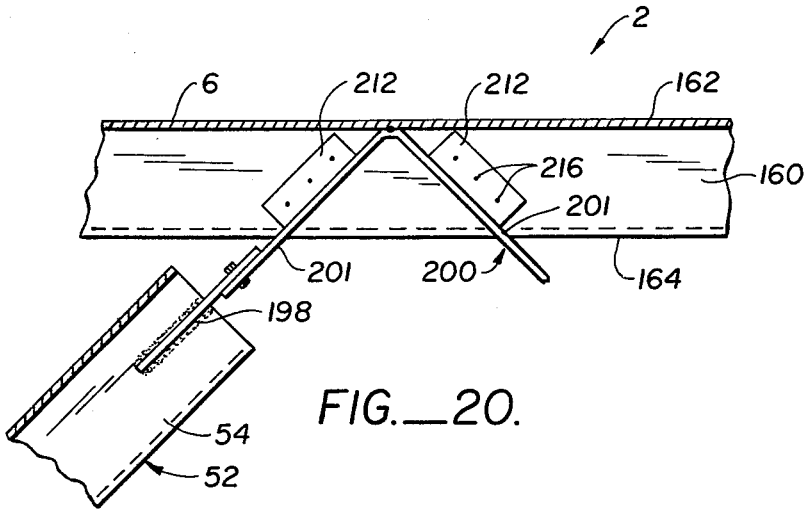
FIG. 20 is a fragmentary side elevational view similar to FIG. 16 but shows an alternative construction for the connection between the diagonal webs and the chord plates.
Figure 21:
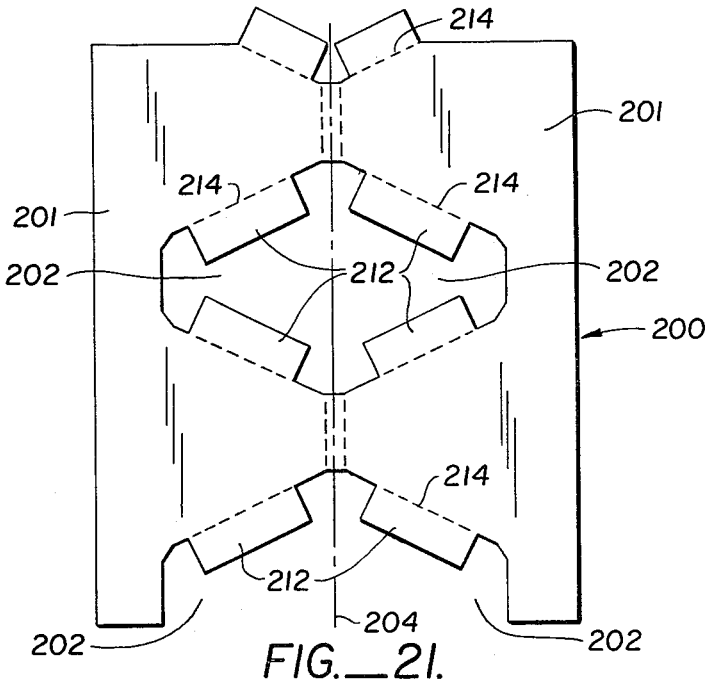
FIG. 21 is a plan view similar to FIG. 18 and illustrates the blank used in the embodiment shown in FIG. 20 from which the member connecting the webs to the chord plates is constructed.

Referring now to FIGS. 20 and 21, an alternative manner of connecting gusset plate 200 to the upper chord plate 6 to that shown in FIGS. 16–17 is illustrated. This alternative provides the gusset plate with multiple tabs 212 which are formed from the material left in the gusset plate blank to define cutouts 202. The tabs are bent approximately 90° relative to gusset plate legs 201 about bend lines 214 and they are thereafter suitably secured to corrugation sides 160 between corrugation peaks and valleys 162, 164 with bolts, rivets, welds, or as is shown in FIG. 20, with spot welds 216.

Figure 15:
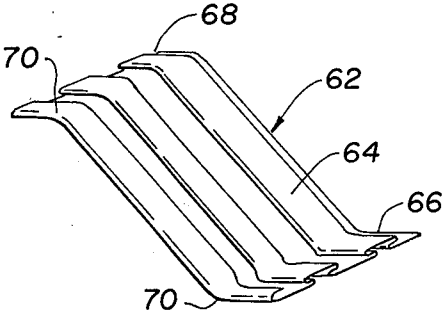
FIG. 15 is a view similar to FIG. 14 but illustrates another manner of constructing the web in accordance with the present invention.

Referring now briefly to FIG. 15, another alternative provided by the present invention for use in instances in which the above-discussed flow-forming equipment is not available provides that a Z-shaped web element 62 be corrugated as above-described, its length being the combined length of a center section 64 of the web and the two protruding end sections 66 and 68. Instead of forming a curved crown section as previously described the corrugations of the web in the vicinity of the end sections are flattened as is illustrated in FIG. 15. Thereafter, bends 70 are formed in the flattened corrugations to angularly deflect the end sections relative to the center section so that they are parallel to each other and the center section has the desired angular inclination relative to the chord plates (not shown in FIG. 15), Again, this construction of the webs, though it affords the advantages of a full width support for the chord plates, is of somewhat lesser strength than the preferred construction of the sinusoidal support having continuously curved crown sections.

Figure 22:
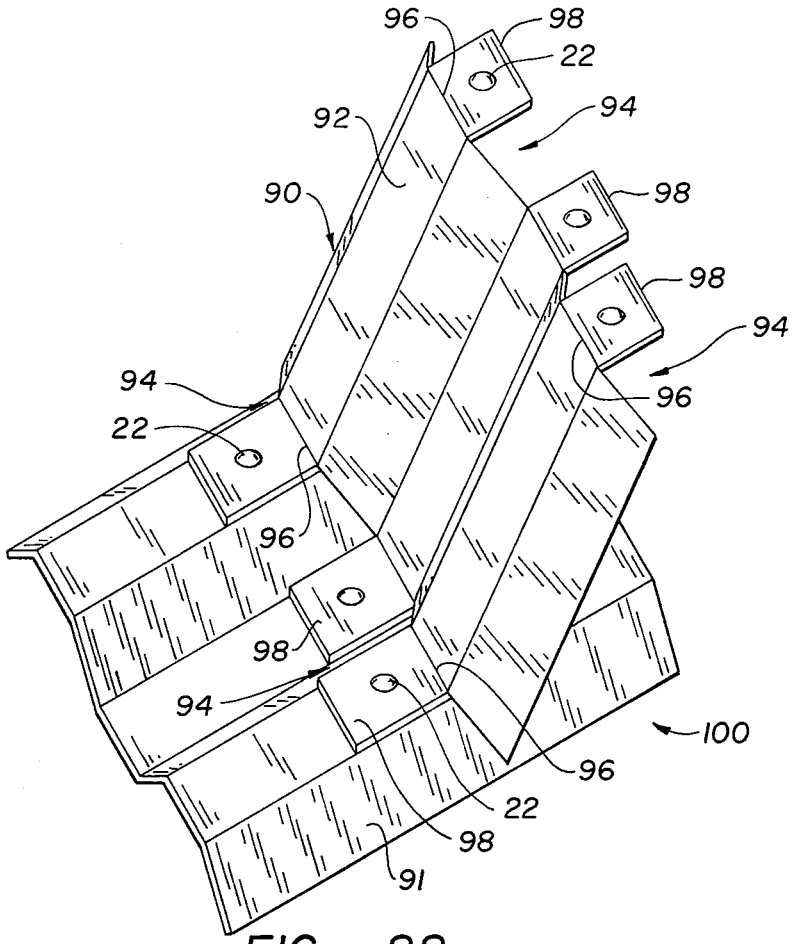
FIG. 22 is a perspective side elevational view of a simplified web construction employing straight web sections between and secured to the chord plates.

Referring to FIG. 22, in a simplified embodiment of the present invention, diagonal web elements 90 for interconnecting a lower chord plate 91 with an upper chord plate (not shown in FIG. 22) are constructed of an angularly inclined, straight length of corrugated plate 92. Notches 94, are formed in the ends of web 90 to define fingers which are then bent about bend lines 96 so that generally horizontally disposed connector plates 98 are formed which abut the upper and lower chord plates. Fasteners, such as the schematically illustrated bolts 22 secure the connector plates to the chord plates, resulting in a bridge module 100 that does not require the curving of the web elements as above-discussed. Such webs, however, have a somewhat lesser strength and are primarily intended for lesser load applications. Important aspects of the present invention such as the lightweight construction of the bridge, the lateral rigidity of the bridge sections, and the uniform support of the upper chord plates however, are fully realized in this embodiment of the invention.

Figure 24:
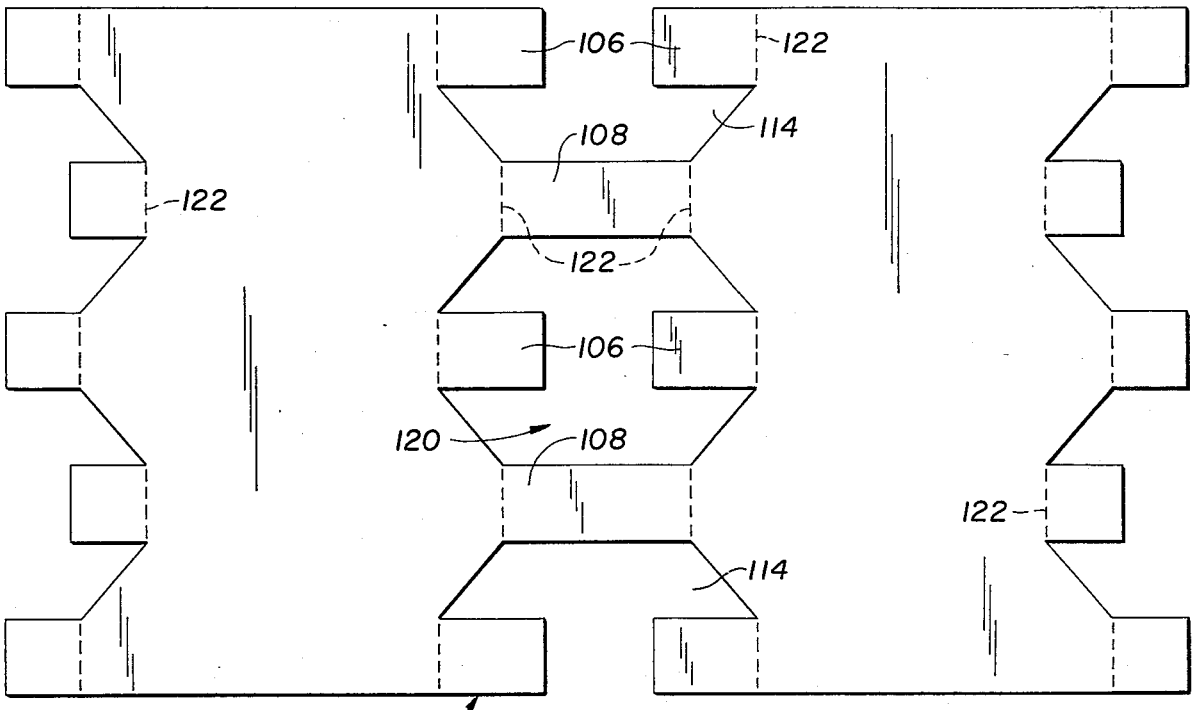
FIG. 24 is a plan view of the flat plate blank from which the corrugated web shown in FIG. 23 is fabricated.
Figure 23:
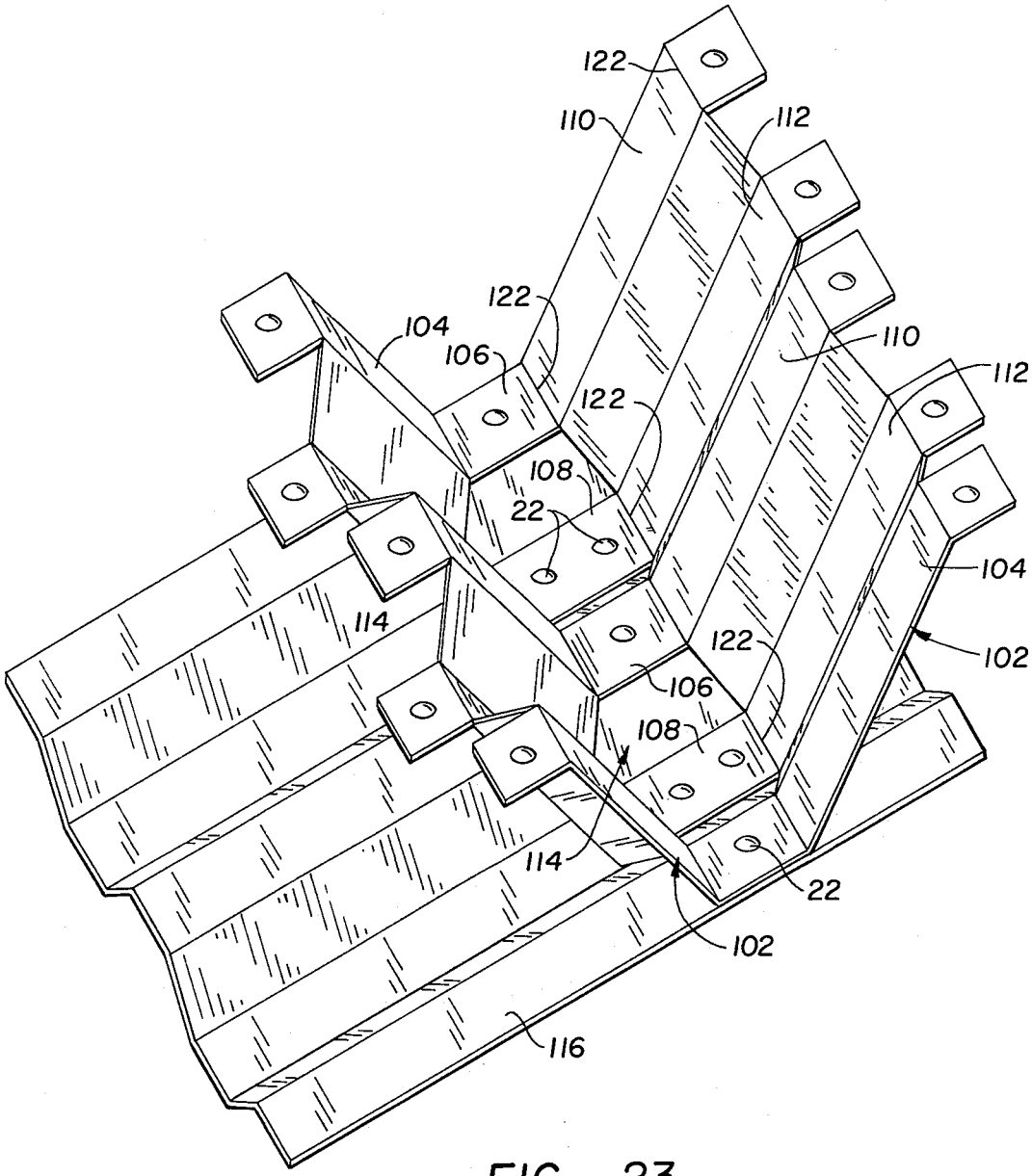
FIG. 23 is a perspective, side elevational view similar to FIG. 22 and illustrates a modified construction of the chord plate connecting webs.

Referring to FIGS. 23 and 24, the webs 90 shown in FIG. 22 can be made of a series of integrally constructed, corrugated metal web elements 102 which have a straight, diagonal center section 104 interconnected by alternating relatively short and long mounting plates 106 and 108, respectively. The mounting plates are longitudinally aligned with the peaks and troughs 110, 112 of the corrugated plate and they are separated by trapezoidal cutouts 114. Suitable bolts 22, rivets or the like secure the mounting plates 106, 108 to corresponding peaks and troughs of chord plates 116 (only the lower chord plate is shown in FIG. 23).

Any desired number of webs 102 can be integrally constructed. For example, all webs disposed over the length of the bridge may be integrally constructed by providing a flat blank 118 of the required length, stamping out the appropriate, generally H-shaped cutouts 120 (see FIG. 24) which in turn define mounting plates 106, 108 and trapezoidal cutouts 114, and corrugating the blank to give it the desired corrugation pitch and depth. Thereafter, the corrugated blank (not separately shown) is bent about bend lines 122 to give it the shape shown in FIG. 23 and define the individual chord plate supporting the interconnecting webs 102. The webs generally have the same characteristics as the webs shown in and described in connection with FIG. 22 except that two or more webs are integrally constructed, thereby reducing the installation time and cost.

Figure 25:
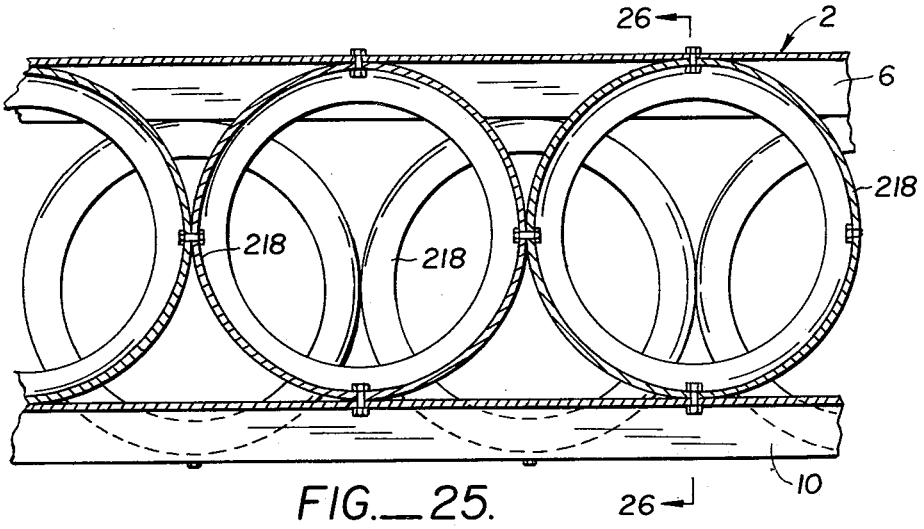
FIG. 25 is a fragmentary, side elevational view and illustrates another embodiment of the invention which utilizes generally circular web members connecting the chord plates.
Figure 26:
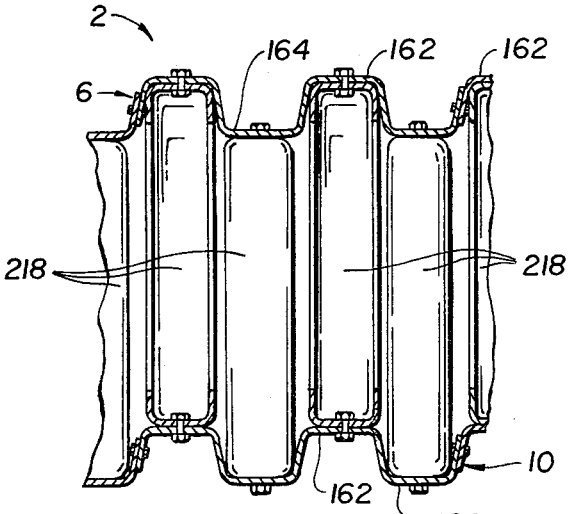
FIG. 26 is a fragmentary, cross-sectional view and is taken on line 26—26 of FIG. 25.

Referring to FIGS. 25 and 26, in still another embodiment of the present invention, upper and lower chord plates 2, 10 of bridge module 2 are interconnected with multiple, side-by-side circular supports 218 which have a generally U-shaped cross-section. The circular members are securely attached, e.g. bolted to opposing corrugation peaks or valleys 162, 164 of the upper and lower chord plates 6, 10. Although the circular support members are not of a unitary width, their lateral spacing is sufficiently close so that the small gap between them is negligible. Consequently, the side-by-side circular support acts as a continuous web member which extends over substantially the full width of each bridge module as above discussed. Depending on the particular application, the circular support members 218 may be alternatingly offset, as is illustrated in phantom lines in FIG. 25, to achieve desired architectural effects and to eliminate the need for intermediate load distribution ribs (not shown in FIGS. 25, 26) although in such instances the overall strength of the bridge is somewhat lessened and this embodiment of the invention is, therefore, primarily applicable to relatively low load applications.

Figure 28:
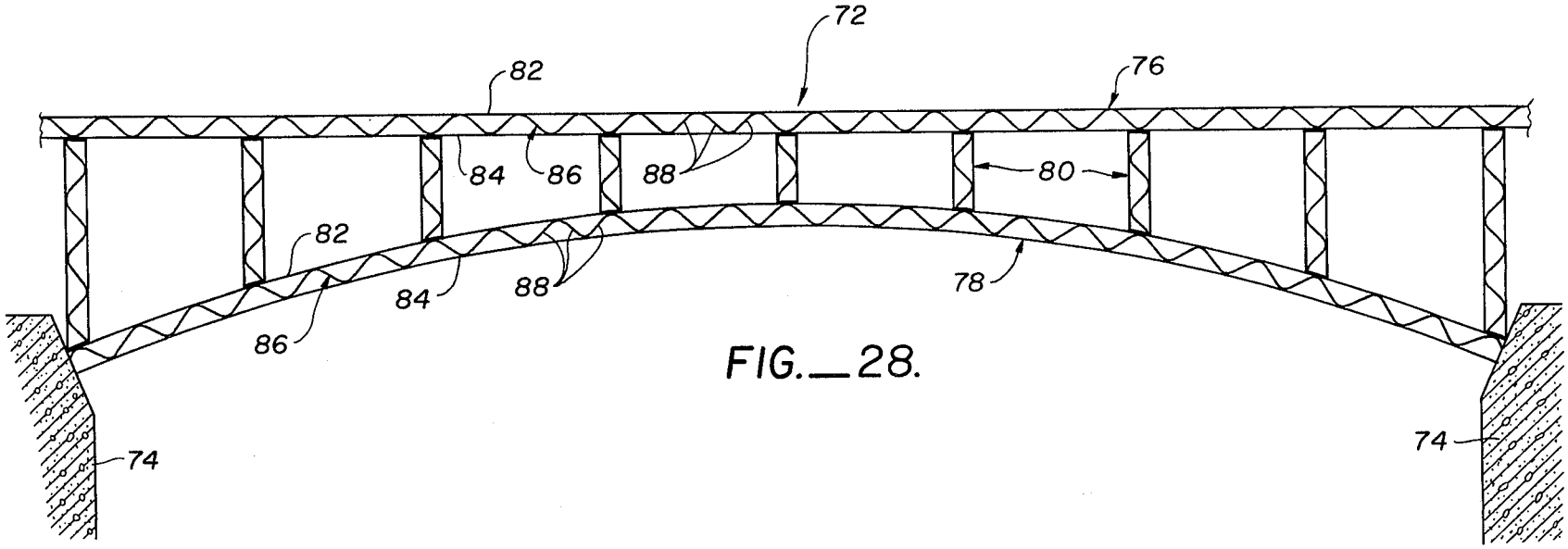
FIG. 28 is a side elevational view of an arch-type bridge construction employing modular, longitudinal bridge sections constructed in accordance with the present invention.

Referring to FIG. 28, the present invention can be equally advantageously employed in connection with bridges designed for relatively long spans such as an arch bridge 72 suspended between a pair of bridge abutments 74. The arch bridge is again constructed of longitudinal bridge modules, a plurality of which are arranged side-by-side to define the full width of the bridge. Each bridge section is constructed of an upper chord 76, a lower chord 78 and interconnecting verticals 80. If required diagonals (not shown in FIG. 28) may also be installed between the upper and lower chords.

Each of the chords, and if desired each of the verticals, in turn is constructed of upper and lower chord plates 82 and 84. In the case of lower chord 78 the chord plates are curved while in the case of verticals 80 the chord plates are vertically arranged. A sinusoidal support member 86 defined by a plurality of webs 88 arranged end to end are constructed as above-discussed from corrugated plate. The advantages attained from this construction as discussed above are equally available in more intricate bridge designs such as the arch bridge shown in FIG. 28.

We claim:

1. A modular bridge for suspension between spaced apart bridge supports comprising: a plurality of side by side truss-deck modules each having an upper chord plate constructed of corrugated plate having longitudinally extending, parallel corrugations; a substantially parallel, spaced apart lower chord plate; a plurality of serially arranged, longitudinally aligned diagonals disposed between the chord plates, the diagonals being inclined relative to the chord plates and including a center section disposed between the chord plates and constructed of corrugated plate having a plurality of side by side corrugations which extend in the direction of the corrugations in the upper chord plate, the diagonals having a width substantially equal to the width of the upper chord plate, and means for securing the diagonals to the chord plates so that the diagonals support the upper chord plate over substantially its full width, whereby the diagonals distribute a vehicular load carried by the upper chord plate laterally relative to the plate and thereby cause a more uniform stressing of the upper chord plate.

2. A bridge according to claim 1 including means for securing the modules to each other to prevent relative lateral movements between them.

3. A bridge according to claim 2 wherein the securing means includes beam means secured to an underside of the upper chord plate, the beam means having a length substantially equal to the combined width of the modules and being positioned intermediate longitudinally spaced apart points of attachment for a pair of adjacent diagonals.

4. A bridge according to claim 1 including load distributing means secured to the upper chord plate for distributing vehicular loads in a transverse bridge direction and located intermediate longitudinally spaced apart points on the upper chord plate at which contiguous diagonals are attached thereto, whereby vehicular loads applied to such intermediate points are distributed over an extended width of the upper chord plate to reduce the stressing thereof by the vehicular load.

5. A bridge according to claim 4 wherein the load distributing means comprises beam means disposed beneath the upper chord plate and in contact with the upper chord plate only, and means for securing the beam means to the upper chord plate, the beam means extending over substantially the full combined width of the modules.

6. A bridge according to claim 4 wherein the load distributing means comprises a rigid member disposed above the chord plate, and means for mechanically interlocking the rigid member with the chord plate.

7. A bridge according to claim 6 wherein the rigid member comprises a layer of concrete poured onto the upper chord plate.

8. A bridge according to claim 6 wherein the interlocking means comprises a plurality of protuberances in at least one of the upper chord plate and the rigid member and a like plurality of complementary depressions in at least one of the other one of the chord plate and the rigid member.

9. A bridge according to claim 5 wherein the beam means comprises a channel member.

10. A modular bridge for placement between spaced apart supports comprising: a plurality of side-by-side truss-deck modules, each module having spaced apart upper and lower chord plates and intermediate, chord plate connecting web means, the web means having a width substantially equal to the width of the upper chord plate, the upper chord plate simultaneously defining a deck for supporting vehicular traffic; load distributing beams having a length substantially equal to the combined width of the modules, the beams being disposed intermediate points of attachment between the upper chord plates and the web means, the beams having a relative stiffness when subjected to vehicular loads in a transverse bridge direction which exceeds the stiffness of the upper chord plate in that direction; and means for rigidly securing the load distributing beams to an underside of the chord plate only; whereby the beams in connection with the web members distribute vehicular loads in a transverse bridge direction over a substantial width of the bridge to reduce the stress induced by the vehicular load on the upper chord plate.

11. A bridge according to claim 10 wherein the upper chord plate of each module is constructed of longitudinally corrugated plate.

12. A bridge according to claim 11 wherein the web means is constructed of corrugated plate having a corrugation pitch equal to that of the upper chord plate.

13. A bridge according to claim 12 wherein the upper chord plate has a width less than about 52 inches.

14. A bridge according to claim 13 wherein the upper chord plate has an effective width of about 32 inches, and wherein the plate includes at least two full corrugations.

15. A bridge according to claim 14 wherein the upper chord plate has a corrugation depth of at least about 5½ inches.

16. A bridge according to claim 12 wherein the web means has a corrugation depth equal to that of the upper chord plate; wherein the web means includes a diagonal center section with upper and lower crown sections; wherein corrugation peaks and troughs of the upper crown section are nested within aligned corrugation peaks and troughs of the upper chord plate, including means establishing metal-to-metal contact areas between nesting corrugation peaks and troughs and fastening means disposed at the contact areas, securing the upper crown sections to the upper chord plate, and generating a friction connection between the crown section and the upper chord plates at the contact areas.

17. A bridge according to claim 16 wherein the metal-to-metal contact establishing means is defined by a generally circular boss in one of the upper chord plate and the upper crown section.

18. A bridge according to claim 17 wherein the boss is formed in the upper crown section, and wherein the fastening means comprises bolt means extending through aligned apertures in the boss and in the upper chord plate.

19. A bridge according to claim 16 wherein the corrugations have a generally trapezoidal cross-section defining generally parallel, horizontal corrugation peaks and troughs, and wherein the fastening means is disposed at and extends through the horizontal corrugation peaks and troughs of the upper chord plate and the upper crown section.

20. A bridge according to claim 19 wherein the metal-to-metal contact establishing means is defined by differences in the base width of nesting corrugation peaks and troughs of the upper chord plate and the crown sections.

21. A bridge according to claim 20 wherein the base width difference is uniform and extends over the full length of the corrugations of the upper chord plate and the web means.

22. A bridge according to claim 10 wherein the chord plates and the web means are constructed of corrugated steel plate having a yield stress of at least about 50,000 psi, the plates and the web means being corrugated from flat sheet metal stock having a flat width of no more than about 52 inches and having no more than about two complete, longitudinally extending corrugations.

23. A bridge according to claim 22 wherein the corrugations have a pitch of at least about 16 inches and a depth of no more than about 6 inches.

24. A bridge according to claim 10 including intermittently spaced, upright posts mounted to lateral sides of the bridge defined by the two outermost modules of the bridge, the chord plates of such modules being constructed of longitudinally corrugated plate, the posts having a lower end rigidly secured to the lower chord plate, an intermediate portion rigidly secured to the upper chord plate, and an upper end protruding above the upper chord plate a sufficient distance so that a protective guard rail for the bridge can be attached thereto.

25. A bridge according to claim 24 including an elongated, generally horizontally disposed member rigidly secured to the lower end of the post, extending transversely of the bridge over at least two lower chord plate corrugations, and means rigidly attaching the member to said corrugations to form said rigid connection.

26. A bridge according to claim 25 including generally horizontally disposed tie-plate means rigidly secured to the intermediate post portion, extending transversely of the bridge over at least two upper chord plate corrugations, and means rigidly attaching the tie-plate means to said corrugations to form said rigid connection.

27. A lightweight, high efficiency modular bridge constructed of a plurality of pre-assembled bridge modules, the bridge comprising: a plurality of longitudinally extending side-by-side modules, each module having spaced apart upper and lower chord plates, at least the upper chord plate being constructed of corrugated plate; a plurality of chord plate connecting diagonal web members arranged over the length of the chord plates, the web members being constructed of corrugated plate; means for attaching the web members to the chord plates, the attaching means securing the web members to the chord plates over substantially the full width thereof so as to intermittently support the upper chord plate with the web members over its substantially full width; and lateral load distributing means connected to an underside of the upper chord plate at locations about midway between adjacent attaching means for the web members for distributing vehicular loads at such midway locations over an extended lateral width of the upper chord plate, the load distributing means including a load distributing rib having a moment of inertia $$I = k \cdot I_l \frac{S^4}{S_1^3} \text{ (in}^4\text{) wherein}$$

$k$ = a constant in the range of between about 2 to 120;
$I_1$ = the average moment of inertia of the corrugated upper chord plate per inch width (in in$^4$);
$S_1$ = the spacing between adjacent web member attaching means (in inches);
S = the spread of a vehicular load over a given width of the upper chord plate (in inches) due to the effective height of the upper chord plate and the width of vehicle wheels;

and means for securing the ribs to the underside of the upper chord plate.

28. A bridge according to claim 27 wherein the rib has a U-shaped cross-section.

29. A bridge according to claim 27 wherein the upper chord plate has a plurality of contiguous corrugations with a generally trapezoidal cross-section, and wherein the rib has a cross-section complementary to that of the upper chord plate.

30. A bridge according to claim 29 wherein the web member has corrugations complementary to the corrugations of the upper chord plate.

31. A bridge according to claim 30 wherein the web member has a width substantially equal to the width of the upper chord plate.

32. A lightweight, high efficiency module for constructing a modular bridge by arranging a plurality of pre-assembled bridge modules side-by-side, the module comprising: spaced apart upper and lower chord plates, at least the upper chord plate being constructed of corrugated plate; a plurality of chord plate connecting diagonal web members arranged over the length of the chord plates, the web members being constructed of corrugated plate; means for attaching the web members to the chord plate, the attaching means securing the web members to the chord plates over substantially the full width thereof so as to intermittently support the upper chord plate with the web members over its substantially full width; and lateral load distributing means for connection to an underside of the upper chord plate at locations about midway between adjacent attaching means for the web members for distributing vehicular loads at such midway locations over an extended lateral width of the upper chord plate and for securing the modules to each other when placed side-by-side, the load distributing means including a load distributing rib having a moment of inertia $$I = k \cdot I_l \frac{S^4}{S_1^3} \text{ (in}^4\text{) wherein}$$

$k$ = a constant which is a factor of (L'/L) . (S/12);
L = the vehicular wheel load (in lbs.);
L' = (L/S$w$) (in lbs./ft. width of the upper chord plate);
S$w$ = the lateral bridge width over which L is to be distributed (in ft.);
$I_1$ = the average moment of inertia of the corrugated upper chord plate per unit width (in in$^4$);
$S_1$ = the spacing between adjacent web member attaching means (in inches);
S = the spread of a vehicular load over a given width of the upper chord plate (in inches) due to the effective height of the upper chord plate and the width of vehicle wheels;

and means for securing the ribs to the underside of the upper chord plate only.

33. A module according to claim 32 wherein the upper chord plate has a corrugation depth that is greater than a corrugation depth of the web member.

34. A module according to claim 32 wherein the lower chord plate comprises a flat plate.

35. A module according to claim 32 wherein the lower chord plate comprises a corrugated plate.

36. A module according to claim 32 wherein attaching means comprises generally trough-shaped members having a flat base portion attached to the respective chord plates and a pair of obliquely inclined sides having an angle of inclination which corresponds to the angle of inclination of the diagonal web members, and including means for connecting ends of the diagonal web members to the inclined sides.

37. A module according to claim 32 wherein the attaching means comprises a pair of parallel end sections protruding from ends of the web member, the spacing between the end sections equalling the spacing between the chord plates, and means for attaching the end sections to the respective chord plates.

38. A module according to claim 37 wherein the end sections are integrally constructed with at least one web member.

39. A module according to claim 38 wherein the end sections have a substantially flat configuration.

40. A module according to claim 32 wherein the web members have a width substantially equal to a width of the chord plates.

41. A lightweight, high-strength bridge comprising in combination a plurality of elongate, relatively narrow, side-by-side bridge modules mounted between spaced apart bridge supports, each module defining an independent, longitudinal truss for the bridge and comprising a corrugated upper chord plate of the truss having a width and a length equal to the width and length of the module, and simultaneously defining a deck of the bridge for carrying vehicular traffic thereon, a spaced apart lower chord plate having a width substantially equal to the width of the upper chord plate, and a plurality of diagonal webs interconnecting the chord plates, arranged end to end and extending over the length of at least the upper chord plate, and having a width substantially equal to the width of the upper chord plate, each web being constructed of corrugated, relatively lightweight sheet having a corrugation pitch corresponding to the corrugation pitch of the top chord plate, each web further defining a web center section disposed between the upper and the lower chord plates and upper and lower web crest members extending in the direction of the respective chord plates and attached to ends of the web center section, and means for securing the crest members to the respective chord plates.

42. A bridge according to claim 41 wherein each crest member is integrally constructed with portions of at least two adjacent center sections.

43. A bridge according to claim 41 wherein corrugations defining the crest members are at least partially flattened and have a depth substantially less than the depth of the corrugations in the center sections.

44. A bridge according to claim 41 wherein the webs are constructed of corrugated plate defined by a plurality of web elements assembled end-to-end, each element having a corrugated center section that is angularly inclined relative to the chord plates and respective end sections defining said crest members, integrally constructed with the center section, and at least in part disposed substantially parallel to the chord plates.

45. A bridge according to claim 41 wherein the crest members are integrally constructed with at least one adjoining web center section.

46. A bridge according to claim 45 including a continuously curved transitional portion between the crest member and the center section.

47. A bridge according to claim 41 wherein the lower chord plate is substantially parallel and co-extensive with the upper chord plate.

48. A bridge according to claim 41 wherein the lower chord plate is non-parallel with the upper chord plate.

49. A bridge according to claim 48 wherein at least one of the upper and lower chord plates is in turn constructed of another set of upper and lower chord plates and a plurality of diagonal webs arranged end-to-end, interconnecting the other set of chord plates, and having the width of such other chord plate set.

50. A bridge construction according to claim 41 wherein the chord plates and the webs are constructed of a corrosion resistant steel.

51. A bridge construction according to claim 50 wherein the webs have a thickness no more than about 0.25 inch.

52. A bridge according to claim 41 wherein the crest members are defined by spaced apart, substantially parallel end sections connected with the center section.

53. A bridge according to claim 41 wherein the module has an overall width of not substantially more than about 32 inches to facilitate the transport of the modules from an assembly location to the bridge site.

54. A method for erecting a relatively lightweight slab-type bridge truss-deck comprising the steps of forming an upper chord plate having a width and a length sufficient for placement of the plate between bridge supports, the upper chord plate having longitudinally extending corrugations; forming a lower chord plate having a width and a length substantially equal to that of the upper chord plate; forming a plurality of webs from corrugated sheet metal having a given corrugation pitch and depth, the web having a center section and at least one integrally constructed crest section protruding from an end of the center section, angularly inclining the crest sections relative to the center section by incrementally curving a portion of the web from a point spaced from an end of the end section towards the center section about an axis that is perpendicular to the corrugations of the web by furnishing a pair of opposing, complementary concave and convex forming dies having a profile corresponding to the corrugations of the web, the dies having a curved length with a curvature radius corresponding to the desired curvature radius of the curved portion between the crest section and the center section, the curved length extending over an arc which is substantially less than the desired arc length of the curved portion, placing the web between the dies so that only part of the curved portion is disposed between the dies, thereafter forcing the dies against each other to thereby flow-form the curvature in the curved portion, moving the dies apart, advancing the web in a direction parallel to the corrugations by a distance no greater than the curved die length, thereafter repeating the steps of forcing the dies against each other, moving the dies apart, and advancing the web parallel to the corrugations a sufficient number of times until the desired full arc length has been formed in the web; placing a plurality of webs end to end between the upper and lower chord plates so that the crown sections contact the chord plate and the corrugations of the webs and of the chord plates are in mutual alignment; securing the respective crown sections to the chord plates to thereby form the slab section having an undulating, diagonally oriented web support between the chord plates; thereafter placing a number of slab sections onto the bridge support so that the bridge has the desired overall width as defined by the combined width of all slab sections; and securing the sections to each other and to the bridge supports.

55. A lightweight high efficiency modular bridge constructed of a plurality of pre-assembled bridge modules, the bridge comprising: a plurality of longitudinally extending, side-by-side modules, each module having a width less than about 48 inches, spaced apart upper and lower chord plates, and a chord plate connecting sinusoidal support structure alternatingly connected to the upper and the lower chord plates, the support structure having a web-like configuration defined by serially arranged center sections and upper and lower crown portions connected with the center sections, the support structure further having a width substantially equal to the width of the chord plates; means for fastening the crown portions to the chord plates over substantially their full width; the chord plates and the support being constructed of corrugated metal plate defining longitudinally running corrugations, the corrugations of the chord plates and of the support nesting in each other, the corrugations further having a trapezoidal cross-section, a corrugation depth of at least about 5½ inches and a corrugation pitch larger than the corrugation depth; load distribution ribs positioned intermediate fastening points between the crown portions and the upper chord plate, being oriented perpendicular to the upper chord plate corrugations, and having a width so as to contact all modules of the bridge; means for rigidly securing the load distribution ribs to the upper chord plates only; the load distribution ribs having a section modulus which is sufficiently large so that vehicular point loads applied to the upper chord plate in the vicinity of a load distribution rib are transferred by the load distribution rib onto the upper chord plates of the bridge over a width of several feet so as to cause a more even distribution of the vehicular point load on the upper chord plates and thereby reduce the stressing thereof; a plurality of spaced apart upright posts located proximate lateral sides of the outermost modules of the bridge; means rigidly connecting the posts with each of the upper and the lower chord plates so that a portion of the post protrudes above the upper chord plate; a guard rail extending over the length of the bridge and secured to the protruding portions of the upright posts to define lateral safety barriers for the bridge; and a road bed placed on top of the upper chord plate to define a surface on which vehicular traffic can move.

56. A bridge according to claim 55 wherein the corrugations have a pitch of at least about 16 inches, and wherein the corrugated plate is constructed of corrugated steel plate having a yield stress of at least about 50,000 psi.

57. A bridge according to claim 56 wherein the modules have a width no greater than about 32 inches.

58. A bridge according to claim 57 wherein the load distribution member comprises a U-shaped rib having a generally trapezoidal cross-section, a depth and a width substantially the same as that of the corrugations of the upper chord plate.

59. A bridge according to claim 57 wherein the sinusoidal support defines generally straight center sections and crown sections intermediate adjacent center sections, the crown sections being connected to the chord plates, and wherein at least a portion of the crown section is defined by corrugated plate, the corrugations of which have been deformed and flattened in relation to the corrugations of the center sections.

60. A lightweight, high strength bridge comprising in combination a plurality of elongate, narrow, side-by-side bridge modules mounted between spaced apart bridge supports, each module defining an independent, longitudinal truss for the bridge comprising a corrugated upper chord plate of the truss having a width and a length equal to the width and length of the module and simultaneously defining a deck of the bridge for carrying vehicular traffic thereon; a spaced apart lower chord plate having a width substantially equal to the width of the upper chord plate; and a plurality of generally circular spacing elements having zenith points in contact with the upper chord plate and nadir points in contact with the lower chord plate, the spacer elements having a generally trough-shaped cross-section and being generally arranged side-by-side over the width of the module and being further distributed over the length of the module so as to define said truss in conjunction with the chord plates while supporting the upper chord plate over its substantially full width to facilitate the lateral distribution of vehicular point loads applied to the upper chord plate.

61. A bridge according to claim 60 wherein the ring elements are independent of each other and are independently secured to the upper and the lower chord plates.

62. A method for erecting a relatively low cost, lightweight modular bridge comprising the steps of: forming from flat sheet corrugated plate of a unitary width; forming from the plate at least an upper chord plate and a plurality of diagonal webs; forming a lower chord plate; alternatingly attaching the diagonal webs to the upper chord plate and to the lower chord plate so as to assemble finished bridge modules; placing the finished modules side-by-side onto spaced apart supports at a site for the bridge, whereby the combined width of the upper chord plates of the modules defines the overall width of the bridge; interconnecting the modules to prevent relative lateral movements of the modules; and applying a road bed onto the upper chord plate to thereby finish the bridge; whereby the upper chord plate simultaneously forms the load bearing member of a truss and the traffic carrying deck of the bridge.

63. A method according to claim 62 wherein the step of forming the corrugated plate comprises the step of forming the corrugated plate with a maximum width of less than 48 inches.

64. A method according to claim 63 wherein the step of forming the corrugated plate includes the step of giving the flat sheet two full corrugations.

65. A method according to claim 63 wherein the steps of forming and assembling are performed at a location remote from the bridge site; and wherein the step of placing includes the steps of loading the finished modules at the assembly site onto a transport vehicle, moving the transport vehicle to the bridge site; and at the bridge site transferring the finished bridge modules from the vehicle onto the supports.

66. A method according to claim 65 wherein the bridge module has a width no greater than about 32 inches to facilitate the step of moving the bridge from the assembly location to the bridge site.

67. A method according to claim 62 including the step of increasing the lateral distribution of vehicular loads over an extended portion of the width of the upper chord plate to reduce stress concentrations therein by forming load distribution ribs, orienting the ribs transverse to the chord plates of the modules, and attaching each rib to an underside of each upper chord plate at points intermediate attachment points between the upper chord plate and the webs.

68. A method according to claim 67 wherein each ribs has a length substantially equal to the combined width of the bridge modules.

69. A method according to claim 68 wherein the step of forming the ribs includes the step of giving the rib a moment of inertia $$I = k \cdot I_l \frac{S^4}{S_1^3} \text{ (in}^4\text{) wherein}$$

$k$ = a constant which is a factor of $(L'/L) \cdot (S/12)$;
$L$ = the vehicular load (in lbs.)
$L'$ = $(L/S_w)$ (in lbs./ft. width of the upper chord plate);
$Sw$ = the lateral bridge width over which L is to be distributed (in ft.);
$I_1$ = the average moment of inertia of the corrugated upper chord plate per inch width (in$^4$);
$S_1$ = the spacing between adjacent attachment points between the webs and the upper chord plate (inches); and
$S$ = the spread of a vehicular load over a given width of the upper chord plate (in inches) due to the effective height of the upper chord plate and the width of vehicle wheels.

70. A method according to claim 62 wherein the step of interconnecting the modules comprises the step of forming the upper chord plates so that it has a plurality of complete corrugations and so that sides of the upper chord plate are defined by inclined segments intermediate corrugation peaks and corrugation troughs; overlapping inclined corrugation segments of adjacent modules, and fastening the overlapping corrugation segments at intermediate points.

71. A method according to claim 70 including the step of providing a plurality of elongate tie bars, positioning the tie bars transversely to the length of the bridge adjacent the lower chord plate, and attaching each tie bar simultaneously to a plurality of lower chord plates to thereby rigidly interconnect the lower chord plates.

* * * * *